US007249675B2

(12) United States Patent
Hassell et al.

(10) Patent No.: US 7,249,675 B2
(45) **Date of Patent: *Jul. 31, 2007**

(54) PORTABLE STORAGE CONTAINER

(75) Inventors: Jon P. Hassell, Atlanta, GA (US); William P. Apps, Alpharetta, GA (US); Matthew L. Dannenfeldt, Libertyville, IL (US)

(73) Assignee: Rehrig Pacific Company, Los Angeles, CA (US)

( * ) Notice: Subject to any disclaimer, the term of this patent is extended or adjusted under 35 U.S.C. 154(b) by 170 days.

This patent is subject to a terminal disclaimer.

(21) Appl. No.: 10/854,378

(22) Filed: May 25, 2004

(65) Prior Publication Data

US 2005/0263423 A1 Dec. 1, 2005

(51) Int. Cl.
*B65D 71/08* (2006.01)
*B65D 21/00* (2006.01)

(52) U.S. Cl. ..... 206/506; 206/509

(58) Field of Classification Search ..... 206/506
See application file for complete search history.

(56) References Cited

U.S. PATENT DOCUMENTS

| | | | | |
|---|---|---|---|---|
| 2,029,746 | A | 2/1936 | Tufts et al. | |
| 2,061,414 | A | 11/1936 | Tufts et al. | |
| 2,134,875 | A | 11/1938 | Henze | |
| 2,609,120 | A | 9/1952 | Williams | |
| 3,220,603 | A | 11/1965 | Bromley | |
| 3,323,673 | A | 6/1967 | Cowan | |
| 3,940,018 | A | 2/1976 | Schoeller | |
| 3,951,265 | A | 4/1976 | Carroll | |
| 4,106,623 | A | 8/1978 | Carroll | |
| 4,109,791 | A * | 8/1978 | Clipson et al. | 206/506 |
| 4,241,831 | A | 12/1980 | Locatelli | |
| 4,247,004 | A | 1/1981 | Bird | |
| 4,391,369 | A | 7/1983 | Stahl | |
| 4,423,813 | A | 1/1984 | Kreeger et al. | |
| 4,466,541 | A | 8/1984 | Tabler et al. | |
| 4,573,577 | A | 3/1986 | Miller | |
| RE32,223 | E | 8/1986 | Kreeger et al. | |
| 4,643,310 | A | 2/1987 | Deaton et al. | |

(Continued)

FOREIGN PATENT DOCUMENTS

DE 35 11 321 10/1986

(Continued)

OTHER PUBLICATIONS

International Search Report, Oct. 31, 2005.

(Continued)

*Primary Examiner*—Anthony D. Stashick
*Assistant Examiner*—Shawn M. Braden

(57) ABSTRACT

A portable storage container that both stacks and nests with similar containers includes a plurality of walls extending upwardly from a floor. At least one bail member is moveable between a plurality of positions for supporting the similar containers at varying heights. The bail member is moveable between a low nest position and a high nest position. In the low nest position, minimal clearance between the floors of the stacked containers is provided, and the stacked containers have the lowest overall height. In the high nest position, a ledge protruding outwardly from an outer surface of a wall of the upper container is supported on a support portion of the bail arm.

26 Claims, 30 Drawing Sheets

U.S. PATENT DOCUMENTS

| | | | | |
|---|---|---|---|---|
| 4,759,451 | A | 7/1988 | Apps | |
| 4,770,300 | A | 9/1988 | Klein | |
| 4,848,578 | A | 7/1989 | Schafer | |
| 4,863,062 | A | 9/1989 | Holliday | |
| 4,905,833 | A | 3/1990 | Kreeger et al. | |
| 4,947,992 | A | 8/1990 | Schafer | |
| 4,982,844 | A | 1/1991 | Madan et al. | |
| 5,083,666 | A | 1/1992 | Lam | |
| 5,415,293 | A | 5/1995 | Ackermann | |
| 5,494,163 | A | 2/1996 | Apps | |
| 5,609,254 | A | 3/1997 | Loftus et al. | |
| 5,617,953 | A | 4/1997 | Cope | |
| D381,203 | S | 7/1997 | Ackermann | |
| D382,404 | S | 8/1997 | Cope | |
| 5,752,602 | A | 5/1998 | Ackermann | |
| 5,772,033 | A * | 6/1998 | Loftus et al. | 206/506 |
| 5,881,902 | A | 3/1999 | Ackermann | |
| 5,924,572 | A * | 7/1999 | Cope | 206/518 |
| 6,059,114 | A | 5/2000 | Loftus | |
| D436,729 | S | 1/2001 | Aiken | |
| 6,938,772 | B2 | 9/2005 | Aiken et al. | |
| 7,017,745 | B2 * | 3/2006 | Raghunathan | 206/506 |
| 2002/0117420 | A1 | 8/2002 | McDade | |
| 2003/0230510 | A1 | 12/2003 | Aiken et al. | |
| 2005/0224385 | A1 * | 10/2005 | Hassell et al. | 206/506 |
| 2006/0108372 | A1 * | 5/2006 | Aiken et al. | 220/634 |

FOREIGN PATENT DOCUMENTS

| | | | |
|---|---|---|---|
| DE | 35 21 894 | | 1/1987 |
| DE | 199 39 019 | A1 | 2/2001 |
| DE | 200 02 537 | U1 | 7/2001 |
| EP | 0 311 174 | A1 | 4/1989 |
| EP | 0 368 713 | | 5/1990 |
| EP | 0 557 002 | A | 8/1993 |
| EP | 0 697 341 | A | 2/1996 |
| EP | 0 953 509 | A1 | 3/1999 |
| EP | 0 926 073 | A | 6/1999 |
| EP | 1170223 | | 1/2002 |
| EP | 1241105 | | 9/2002 |
| FR | 2 678 585 | | 1/1993 |
| GB | 2 124 588 | A | 2/1984 |
| GB | 2 129 401 | | 5/1984 |
| GB | 2 137 167 | | 10/1984 |
| GB | 2 141 778 | | 1/1985 |
| GB | 2 171 980 | | 9/1986 |
| GB | 2 180 821 | | 4/1987 |
| GB | 2 209 737 | | 5/1989 |
| GB | 2296009 | | 6/1996 |
| GB | 2333285 | | 7/1999 |
| GB | 2333285 | A * | 7/1999 |
| GB | 2340485 | | 2/2000 |
| GB | 2350350 | | 11/2000 |
| GB | 2373239 | | 9/2002 |
| GB | 2373240 | | 9/2002 |
| GB | 2 374 859 | A | 10/2002 |
| GB | 2425302 | | 10/2006 |
| GB | 2427606 | | 1/2007 |
| NL | 790 5105 | | 6/1979 |
| SU | 171783 | | 3/1966 |
| TW | 338405 | | 8/1998 |
| TW | 372539 | | 10/1999 |
| WO | WO 98/01352 | | 1/1998 |
| WO | WO/0027716 | | 5/2000 |
| WO | WO 00/51900 | | 9/2000 |
| WO | WO 00/66440 | | 11/2000 |
| WO | 2005100179 | | 10/2005 |
| WO | 2005115854 | | 12/2005 |
| WO | 2006036868 | | 4/2006 |

OTHER PUBLICATIONS

International Search Report, Aug. 24, 2005.
International Search Report, Feb. 13, 2006.
United Kingdom Search Report, Jun. 27, 2006.

* cited by examiner

PORTABLE STORAGE CONTAINER

BACKGROUND OF THE INVENTION

The present invention relates generally to portable storage containers and more particularly to portable storage containers that provide the ability to select different nesting and stacking depths.

Portable storage containers that both stack and nest with similar containers are commonly used for transporting and storing goods. Nesting is typically achieved when an empty container receives a like container therein such that there is at least some overlap between the walls of the containers. The stacking feature is typically used when an occupied container has a like container supported thereon, such that the goods contained in the lower container are preferably not contacted or damaged by the upper container. Many containers use members known bail members to achieve the stacking feature. Bail members may typically be positioned out of the way for purposes of nesting, but then moved to a stacking position for allowing containers to be stacked thereon.

The bail members in some containers are movable among three positions: a nesting position, a first stack position and a second stack position. In the nesting position, the bail members are out of the way and the upper container can substantially nest within the lower container. The bail members support containers in the first stack position at a first distance from the floor, where the upper container is not substantially nested within the lower container. The bail members also can be moved to the second stack position to support the upper container at a second distance from the floor, where the upper container is partially nested within the lower container.

The depth at which the bail members can support a container stacked thereon is limited because structure for supporting the bail member must be provided and the structure must still be able to nest with a container nested thereon. Providing bail members that extend substantially below the top band of the container can diminish stability and structural integrity. Additionally, the longer the arms of the bail member are, the more likely they are to become misaligned.

SUMMARY OF THE INVENTION

A container according to one embodiment of the present invention provides a low nest position and a high nest position for the bail members. In the low nest position, a container stacked thereon will nest into the container significantly, thereby minimizing the total space occupied by the two containers, while still providing a minimal clearance between the floors of the two containers for short goods stored in the lower container.

In the high nest position, a little more storage space is provided between the floors of the stacked/nested containers, such that larger goods can be stored in the lower container without contact from the upper container. In the high nest position, the bail member is oriented such that a support portion of the bail member spaced upwardly from uppermost edges of the walls. The bail member is outward of the walls of the container, thus permitting the floor and the walls of the upper container to nest significantly into the lower container. The bail member engages a ledge protruding outwardly from an outer surface of the wall of the upper container. For shorter goods that fit between the floors of the upper and lower containers, this provides a very efficient overall stacking height of the containers.

The bail members can also be moved to upper and lower stack positions, wherein the floor of the upper container is supported by the bail members at two different heights. The goods in the lower container are protected from contact by the upper container while providing an efficient overall stacking height of the upper and lower containers.

The bail member selectively movable between the low nest position, the upper stack position and the lower stack position. The pin is at a first axis in the pin opening when the bail member is in the nest position and when the bail member is in the upper stack position. A first distance from the first axis to the floor is less than a second distance from the support portion to the floor in the upper stack position. The support portion is a third distance from the floor and the pin is at a second axis that is outward of the first axis when the bail member is in the lower stack position, the third distance being less than the second distance.

At least one of the walls has a locking recess complementary to a locking projection protruding from the bail member. In one of the stacking positions, the bail member is supported on the wall with the locking projection received in the locking recess when the bail member to retain the bail member in the stacking position.

In use the bail member of the lower container can be moved from a low nest position in which the support portion of the bail member is the first distance from the floor of the lower container to the high nest position in which the support portion is the second distance from the floor of the lower container, the second distance being greater than the first distance. The support portion is above an uppermost edge of walls of the lower container when the bail member is in the high nest position. The upper container can then be nested in the lower container such that a floor of the upper container is below the support portion of the bail member and the upper container is supported on the support portion of the bail member.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
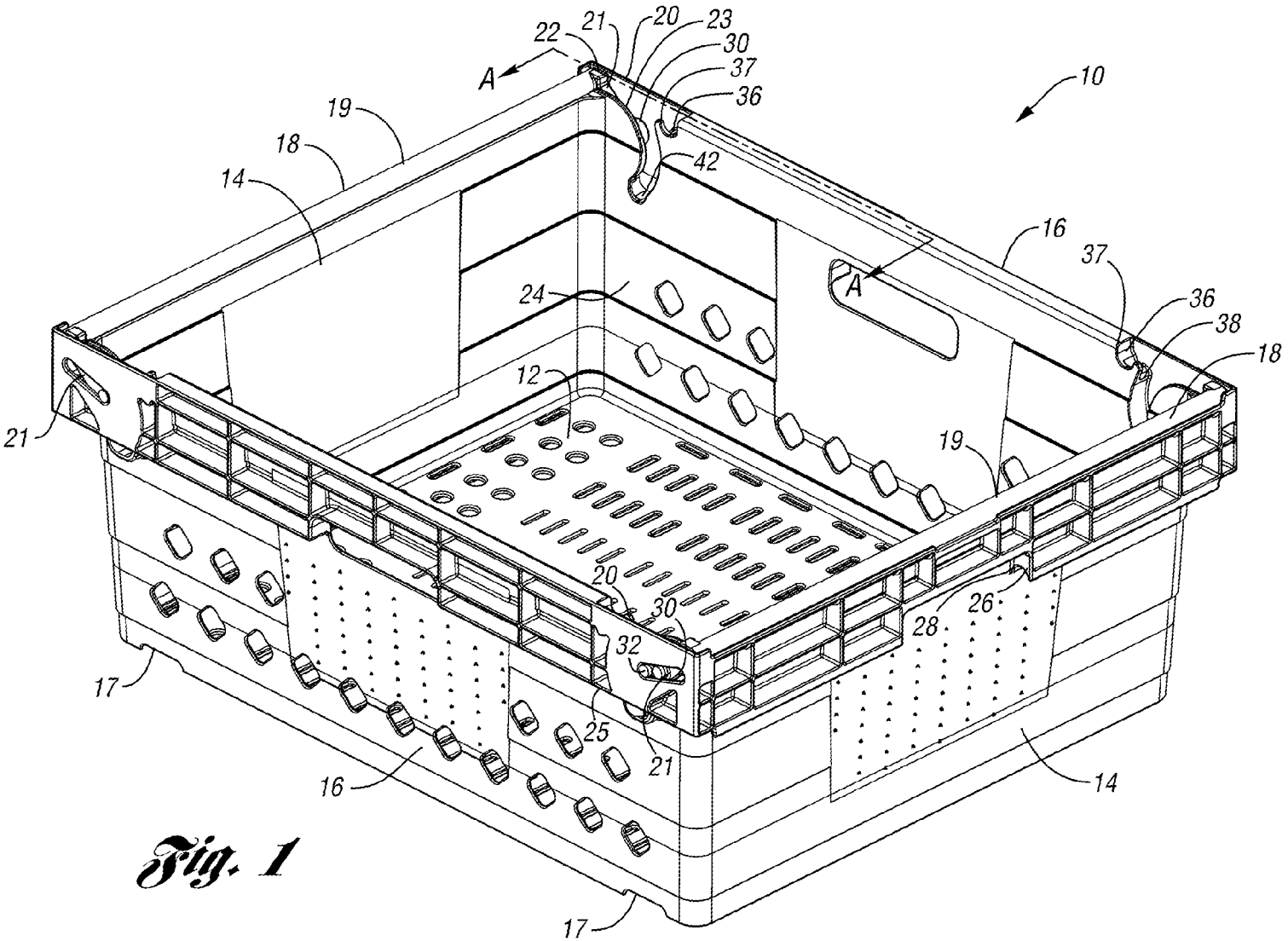
FIG. 1 is a perspective view of a container according to a first embodiment of the present invention with the bail members in a low nest position.

A container 10 according to the present invention is shown in FIG. 1. The container 10 includes a floor 12 and a pair of opposed side walls 14 and a pair of opposed end walls 16. A pair of notches 17 are formed at the bottom of the end walls 16 and the floor 12. The notches 17 each define a channel which extends one end wall 16 to the other.

Two bail members 18 are each mounted to each end wall 16. While they may take a variety of shapes, bail members 18 are shown having a generally cylindrical support portion 19 that extends across the length of the container 10. Each bail member 18 includes a pair of arms 21 extending transversely from the support portion 19. Near the intersection of each arm 21 with the support portion 19, a locking projection 22 protrudes from the support portion 19 and arm 21.

The end walls 16 each include an upper wall portion that has an outer wall portion 20 spaced from an inner wall portion 23. A lower wall portion 24 is generally aligned below the inner wall portion 23, such that the outer wall portion 20 forms a support or ledge 25 along the end wall 16. The side walls 14 similarly include ledges 26 protruding outwardly from the side walls 16 at a height even with the ledges 25 on the end walls 16. The ledges 26 on the side walls 14 include lower concave recesses 28 formed along their length.

The inner wall portion 23 includes an upper support rest 36 at a height above the floor 12 for supporting the bail member 18 at an upper stack position. Each upper support rest 36 includes an upwardly open concave recess 37 adjacent a locking recess 38. The concave recess 37 is a notch formed in the inner wall portion 23. The locking recess 38 is between the inner wall portion 23 and the outer wall portion 20. The inner wall portion 23 further includes a lower support rest 42 which is closer to the floor less than the upper support rest 36 for supporting the bail member 18 at a lower stack position.

Figure 2:
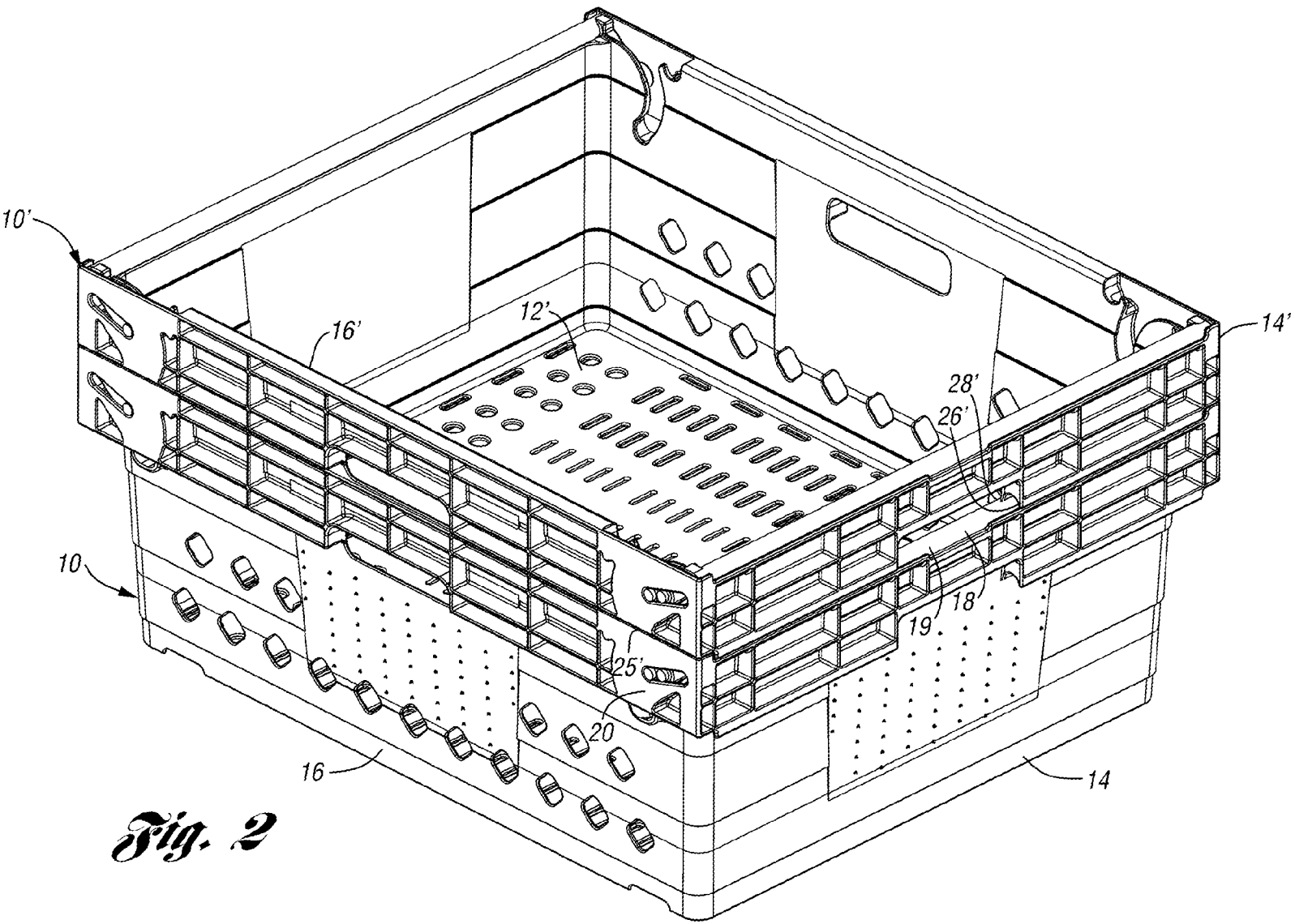
FIG. 2 shows the container of FIG. 1, with a similar container nested therein.

Elongated pin openings 30 are formed in each outer wall portion 20 to trap pins 32 at the outer ends of the bail members 18. The pins 32 are slidable and pivotable within the pin openings 30, such that the bail members 18 can be moved to a plurality of positions and orientations. In FIGS. 1 and 2, the bail members 18 are in a low nest position, where the support portions 19 of the bail members 18 are disposed on the side walls 14 and the pins 32 are at first pivot axes in the pin openings 30. In this position, as shown in FIG. 2, a similar container 10' can be substantially nested within the container 10, with the floor 12' nested within the walls 16 of the container 10. The ledge 26' of the side wall 14' of the upper container 10' is supported on the side wall 14 of the lower container 10, with the support portion 19 of the bail member 18 of the lower container 10 received in the concave recess 28' on the underside of the ledge 26' of the upper container 10'.

Figure 3:
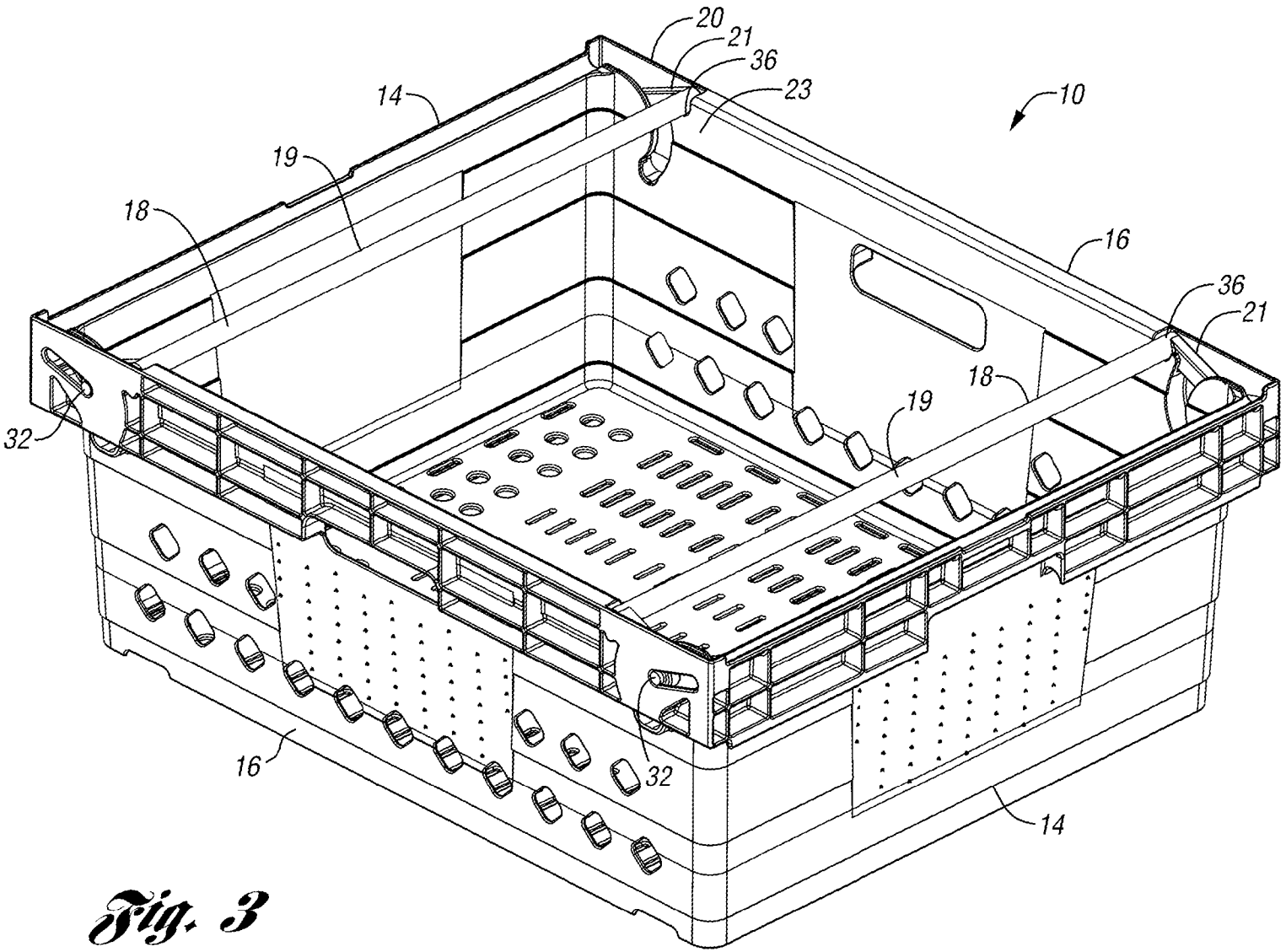
FIG. 3 is a perspective view of the container of FIG. 1 with the bail members in an upper stack position.

The bail members 18 can be pivoted about the pins 32 at the first axes from the low nest position of FIG. 1 to the upper stack position shown in FIG. 3. In the upper stack position, each support portion 19 is supported on two upper support rests 36 on the inner wall portions 23, inwardly of the side walls 14 and suspended above the floor 12 such that an upper surface of the support portion 19 is substantially even with the upper edges of the walls 14, 16. The arms 21 of the bail members 18 are received between the inner wall portions 23 and outer wall portions 20. The inner and outer wall portions 23, 20 prevent contact with the arm 21 by users or by other containers or objects, which prevents the pin 32 from being knocked out of the pin opening 30. The locking projection 22 (visible in FIG. 1) is received in the locking recess 38 (visible in FIG. 1) of the upper support rest 36. The locking projection 22 and locking recess 38 interlock to retain the support portion 19 of the bail members 18 in the upper support rest 36.

Figure 4:
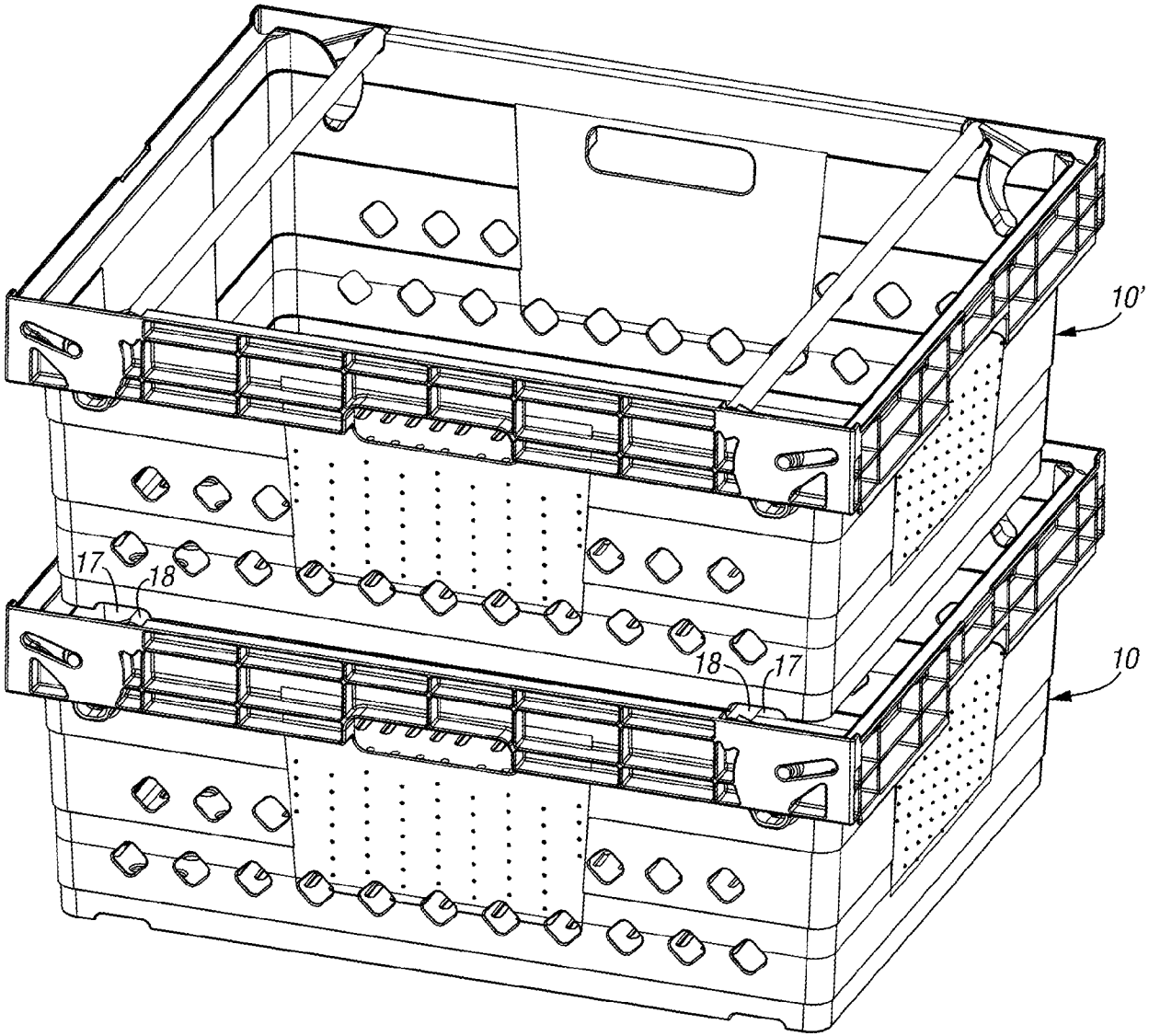
FIG. 4 illustrates the container of FIG. 3, with a similar container stacked thereon.

FIG. 4 shows the container 10 with the bail member 18 in the upper stack position supporting a similar container 10'. The support portion 19 of the bail member 18 of the lower container 10 is received in the notches 17' of the upper container 10' such that the floor 12' of the upper container 10' is supported by the bail members 18. This position provides the maximum storage capacity in the container 10 and transfers load to the bail members 18, thus keeping the weight of the upper container 10' off the container 10 contents.

Figure 5:
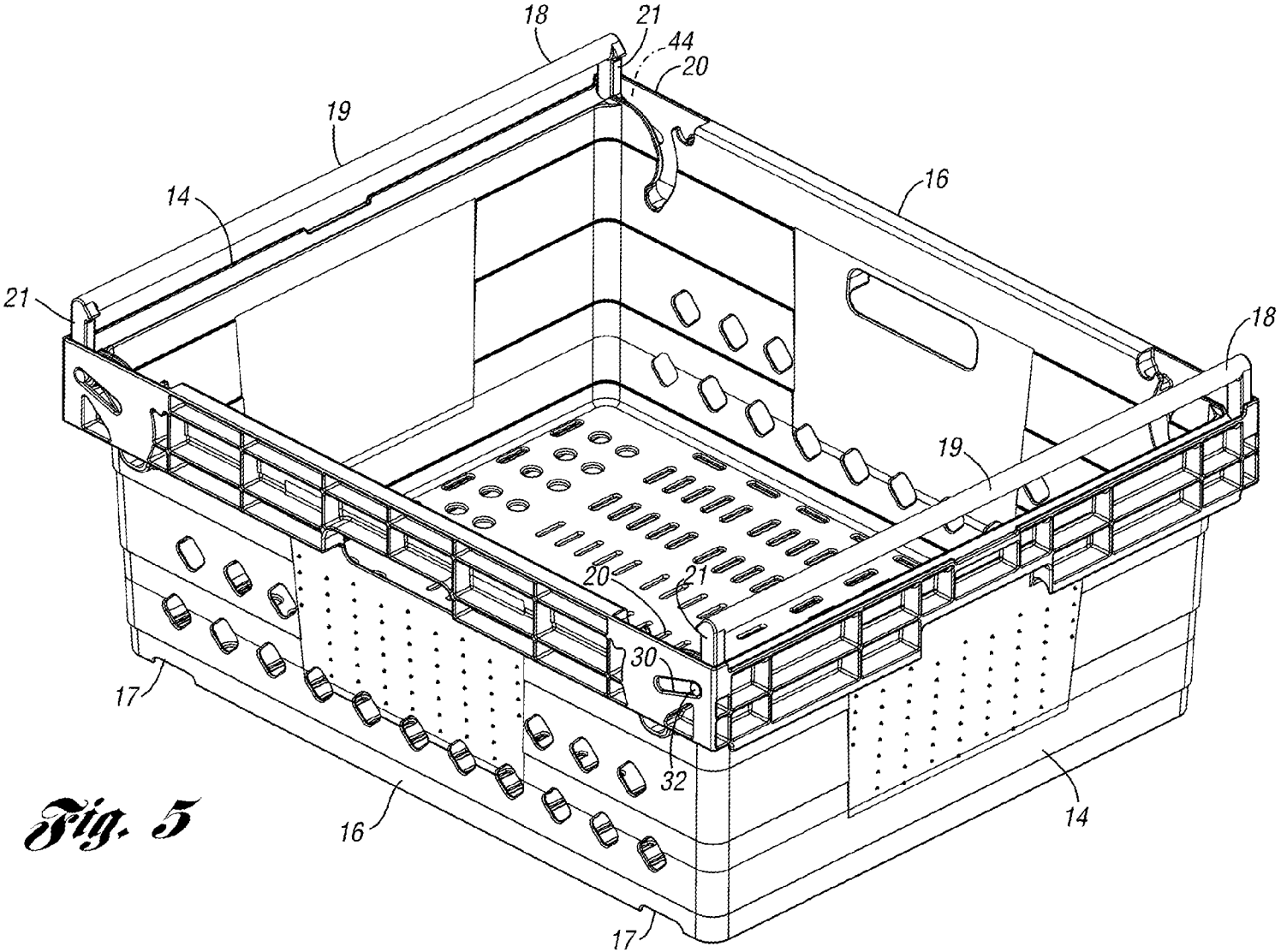
FIG. 5 is a perspective view of the container of FIG. 1 with the bail members in a high nest position.

FIG. 5 shows the container 10 with the bail members 18 in a high nest position. The pins 32 of the bail members 18 are slid to a second axis at an outer end of the pin opening 30 and the bail members 18 are pivoted to an upright position, as shown. In the high nest position, the support portions 19 of the bail members 18 are spaced above uppermost edges of the side walls 14 and end walls 16. The inner surface of the outer wall portion 20 may optionally include a slight projection 44, past which the bail member 18 arm 21 snaps to retain the bail member 18 in the high nest position.

Figure 6:
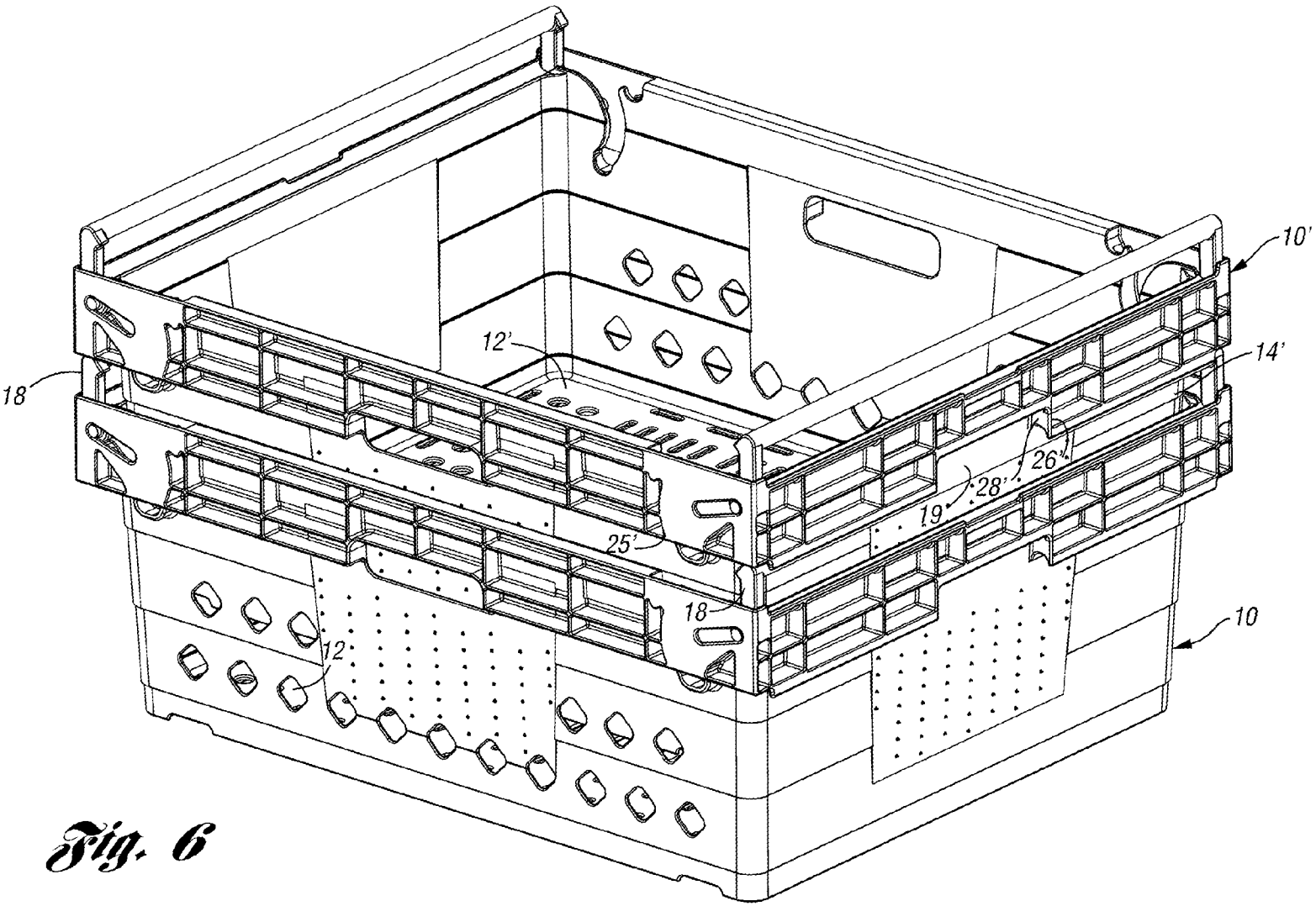
FIG. 6 illustrates the container of FIG. 5, with a similar container stacked thereon.

FIG. 6 shows the container 10 with the bail member 18 in the high nest position supporting a similar container 10', such that the floor 12' of the upper container 10' is suspended at a distance above the floor 12 of the lower container 10 greater than when the bail members are in the low nest position of FIGS. 1 and 2. The floor 12' of the upper container 10' is not in contact with the support portion 19 of the bail member 18 of the lower container 10. In this position, the upper container 10' is supported by the support portions 19 of the bail members 18 of the lower container 10, with the support portions 19 received in the concave recesses 28' formed in the ledges 26' on the side walls 14'. This position provides a small storage space between the floors 12, 12' of the containers, that is slightly larger than the low nest position of FIGS. 1 and 2, without the structural complexities that would be necessary to provide bail members 18 that would extend so sufficiently down into the container to be received under the floor 12' of the upper container.

Figure 7:
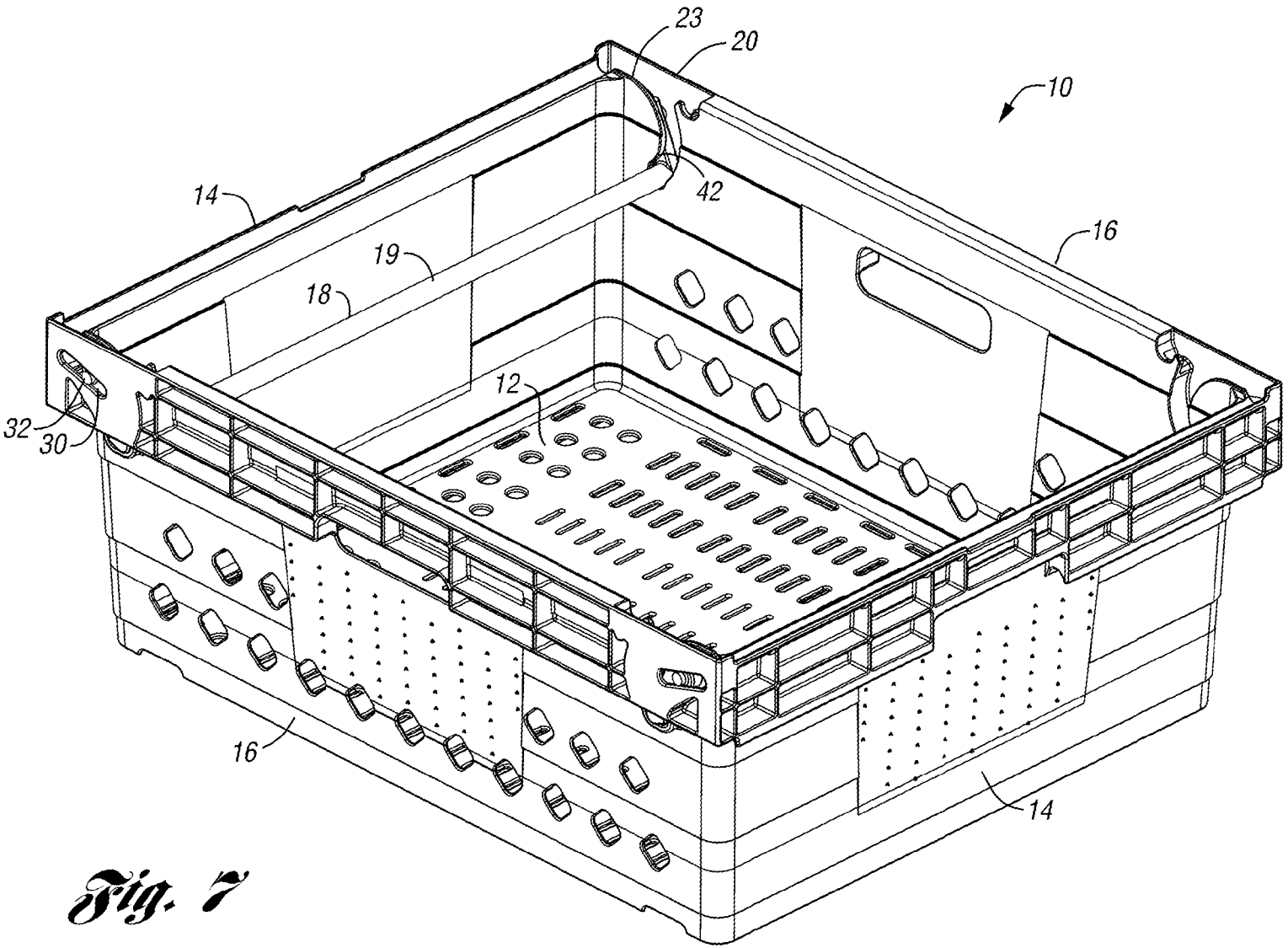
FIG. 7 is a perspective view of the container of FIG. 1 with the bail members in a lower stack position.

FIG. 7 shows the container 10 with the bail members 18 in a lower stack position on lower support rests 42 on the inner wall portions 23 and with the pins 32 at third pivot axes in the pin openings 30. The lower support rests 42 are notches formed in the inner wall portion 23 to impede movement of the bail member 18 out of the selected position. The arms 21 of the bail members 18 are received between the inner wall portions 23 and outer wall portions 20. The inner and outer wall portions 23, 20 prevent contact with the arm 21 by users or by other containers or objects, which prevents the pin 32 from being knocked out of the pin opening 30 when the bail members 18 are in the lower stack position.

Figure 8:
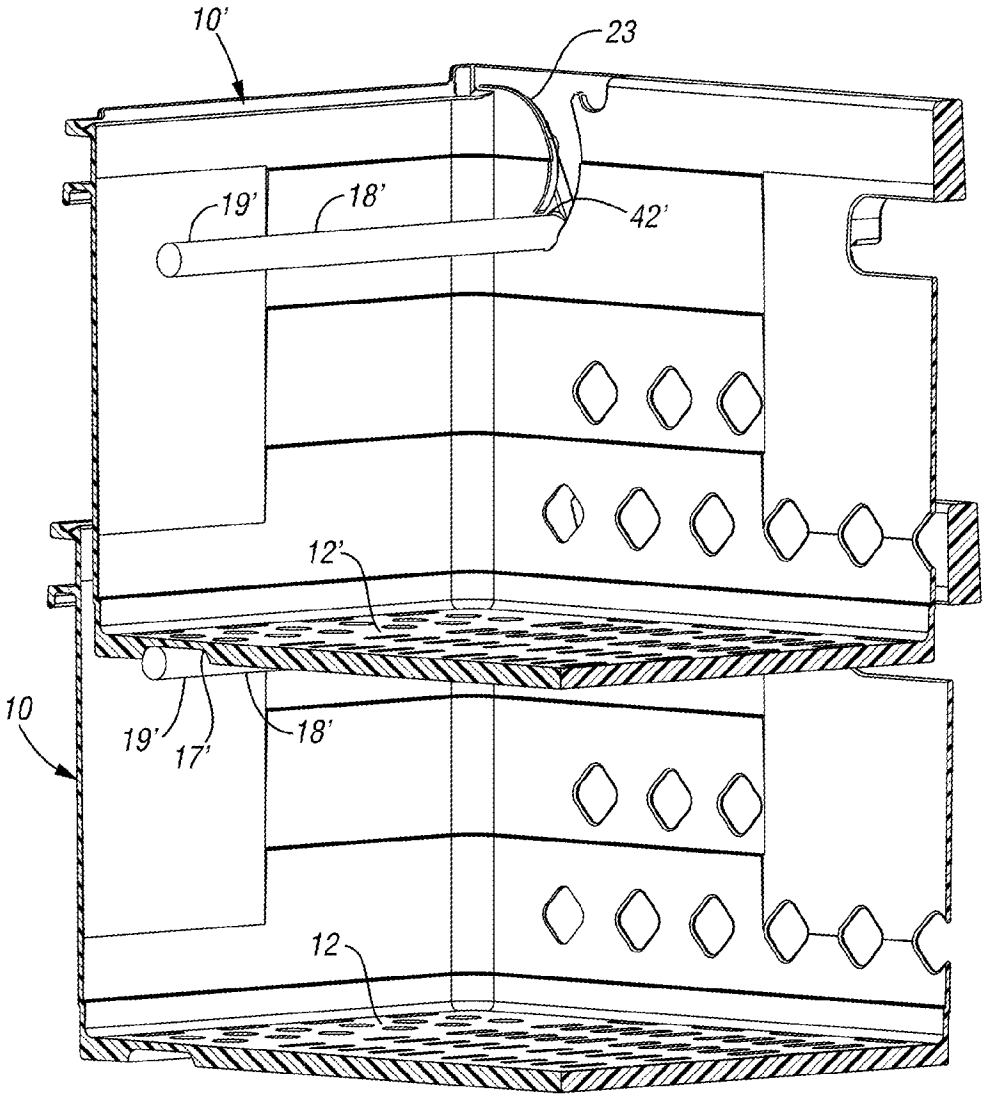
FIG. 8 is a quarter sectioned perspective view of the container of FIG. 7, with a similar container stacked thereon.

As shown in FIG. 8, the upper container 10' is supported above the floor 12 by the bail member 18 in the notch 17' of the upper container 10' to create a middle-sized storage area between the floors 12, 12' that is larger than that provided by the high and low nest positions, but smaller than that provided by the high stack position.

Figure 9:
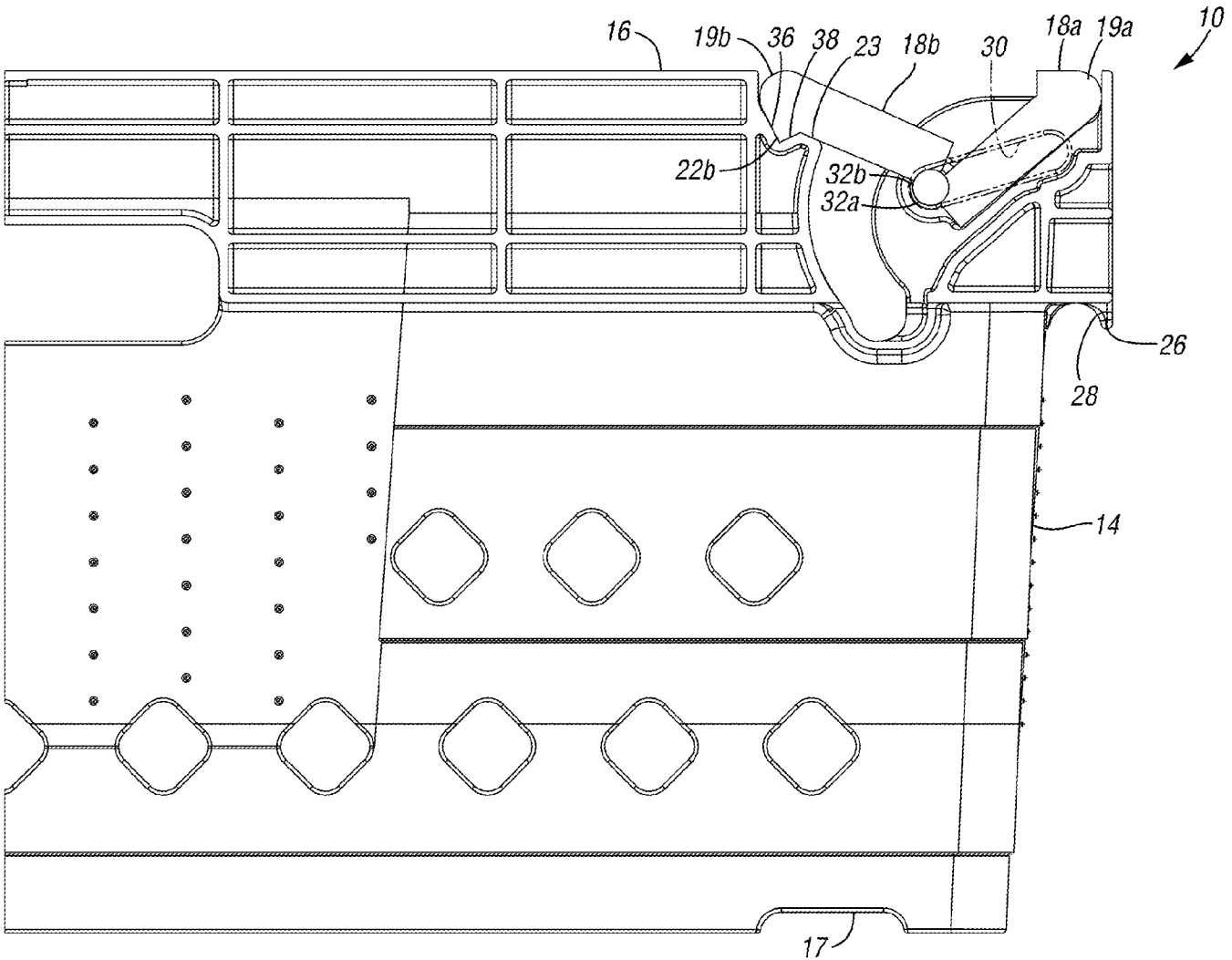
FIG. 9 is a composite sectional view taken along line A-A of FIG. 1, showing one of the bail members in the low nest position and the upper stack position.
Figure 10:
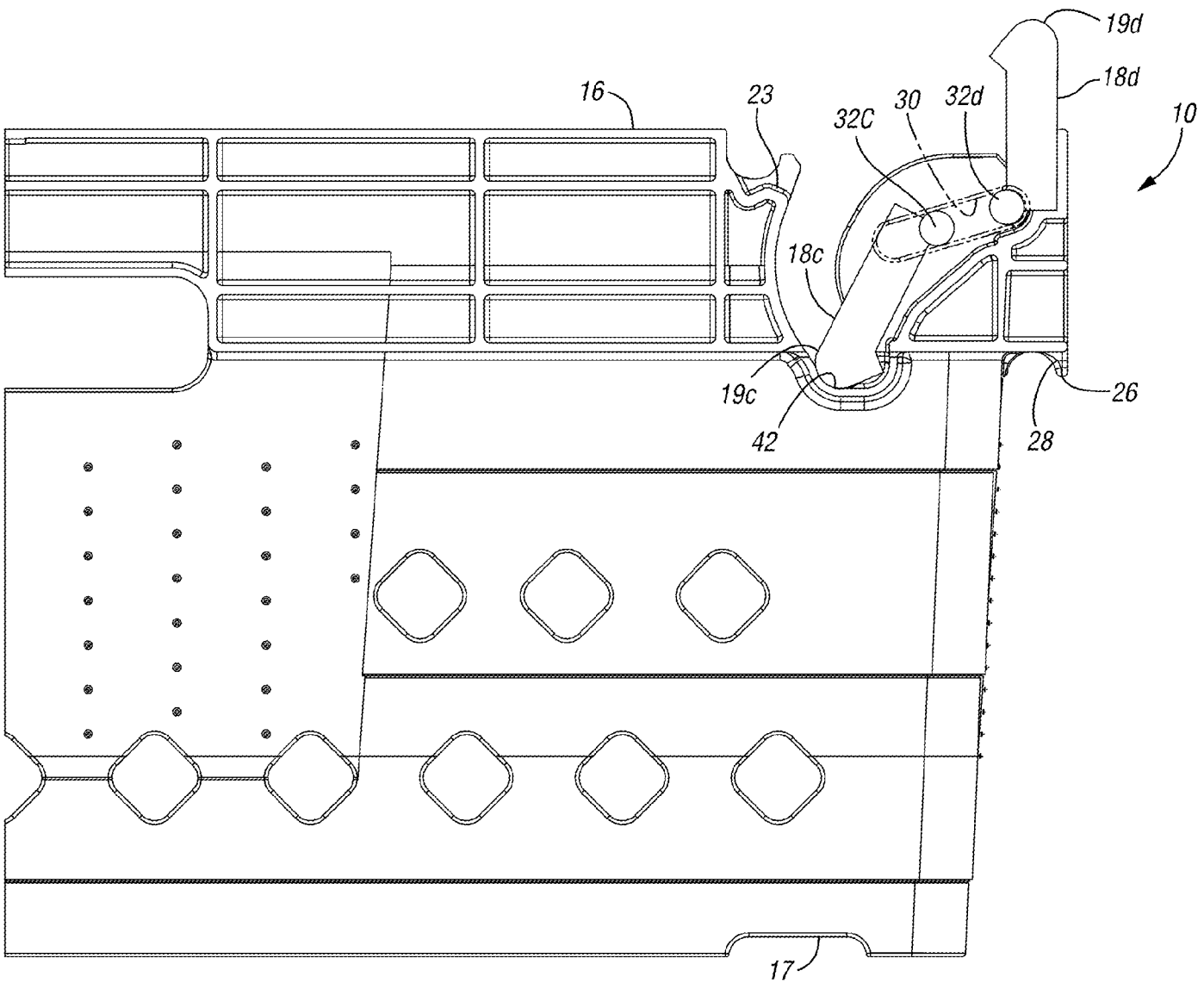
FIG. 10 is a view similar to that of FIG. 9, showing the bail member in the high nest position and the lower stack position.

FIGS. 9 and 10 are sectional views taken along line A-A of FIG. 1, showing in a composite view, the four positions of the bail members 18 and pins 32, with the reference characters "a" through "d" appended to signify the four positions. For clarity, two positions are shown in FIG. 9, while the other two positions are shown in FIG. 10. The pin opening 30 in the outer wall portion 20, which would not otherwise be visible in this view, is superimposed for reference. The pin 32 of bail member 18 is pivotable and slidable in pin opening 30, such that the bail member 18 can be moved between any of the positions shown in FIGS. 9 and 10.

Referring to FIG. 9, bail member 18*a* is in the low nest position with the pin 32*a* in the first pivot axis in the pin opening 30. In the low nest position, the support portion 19*a* of the bail member 18*a* is not inwardly of the side walls 14, and thus permits nesting of a similar container in container 10. In the low nest position, the support portion 19*a* is generally vertically aligned with the concave recess 28 on the ledge 26.

Bail member 18*b* is in the upper stack position, with the pin 32*b* also at the first pivot axis in the pin opening 30. In the upper stack position, the support portion 19*b* of the bail member 18*b* is supported on upper support rest 36 of the inner wall portion 23, at a height substantially equal to the height of the walls 14, 16. The locking projection 22*b* is received in the locking recess 38 of the upper support rest 36. The bail member 18 is simply pivotable about the first axis (shown as pin 32*a* and 32*b*) between the low nest position (bail member 18*a*) and the upper stack position (bail member 18*b*).

Referring to FIG. 10, bail member 18*c* is in the lower stack position with the pin 32*c* in the third pivot axis in the pin opening 30, between inner and outer ends of the pin opening 30. In the lower stack position, the support portion 19*c* of the bail member 18*c* is supported on lower support rest 42 of the inner wall portion 23.

Bail member 18*d* is in the high nest position with the pin 32*d* at the second pivot axis at the outer end of the pin opening 30. In the high nest position, the support portion 19*d* is generally vertically aligned with the concave recess 28 on the ledge 26. The support portion 19*d* of the bail members 18*d* is spaced above uppermost edges of the side walls 14 and end walls 16.

The container 10 provides a low nest position (FIGS. 1 and 2) providing a minimal clearance between floors 12, 12' of stacked containers 10, 10', a high nest position (FIGS. 5 and 6) providing a greater, second clearance, a lower stack position (FIGS. 7 and 8) providing a still greater, third clearance and a upper stack position (FIGS. 3 and 4) providing a greatest, fourth clearance. Depending on how much is to be stored in the container 10, the bail members 18 can be adjusted to support similar containers 10' stacked thereon in the four positions without resting on the contents and without unnecessarily occupying space.

Figure 10A:
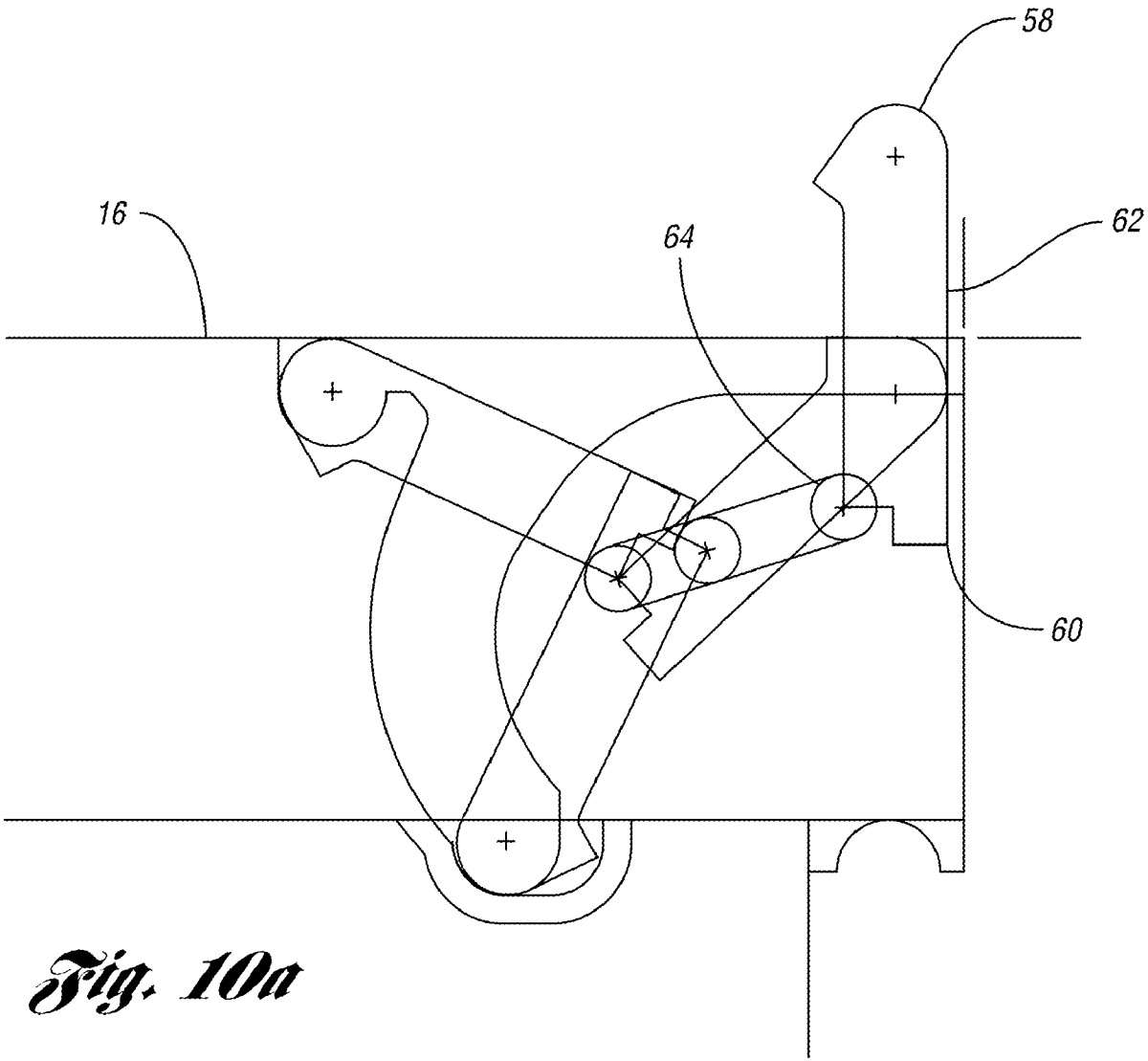
FIG. 10*a* is a view similar to that of FIG. 10, showing an alternative bail member.

FIG. 10*a* is a view similar to that of FIG. 10, showing an alternative bail member 58 with a heel 60 projecting downwardly from the arm 62 outwardly of the pin 64. The heel 60 may optionally be used instead of or in addition to the optional projection 44 shown in FIG. 5 to assist in retaining the bail member 58 in the high nest position. The heel 60 fits snugly or snap-fits into a recess on the wall 16.

Figure 11:
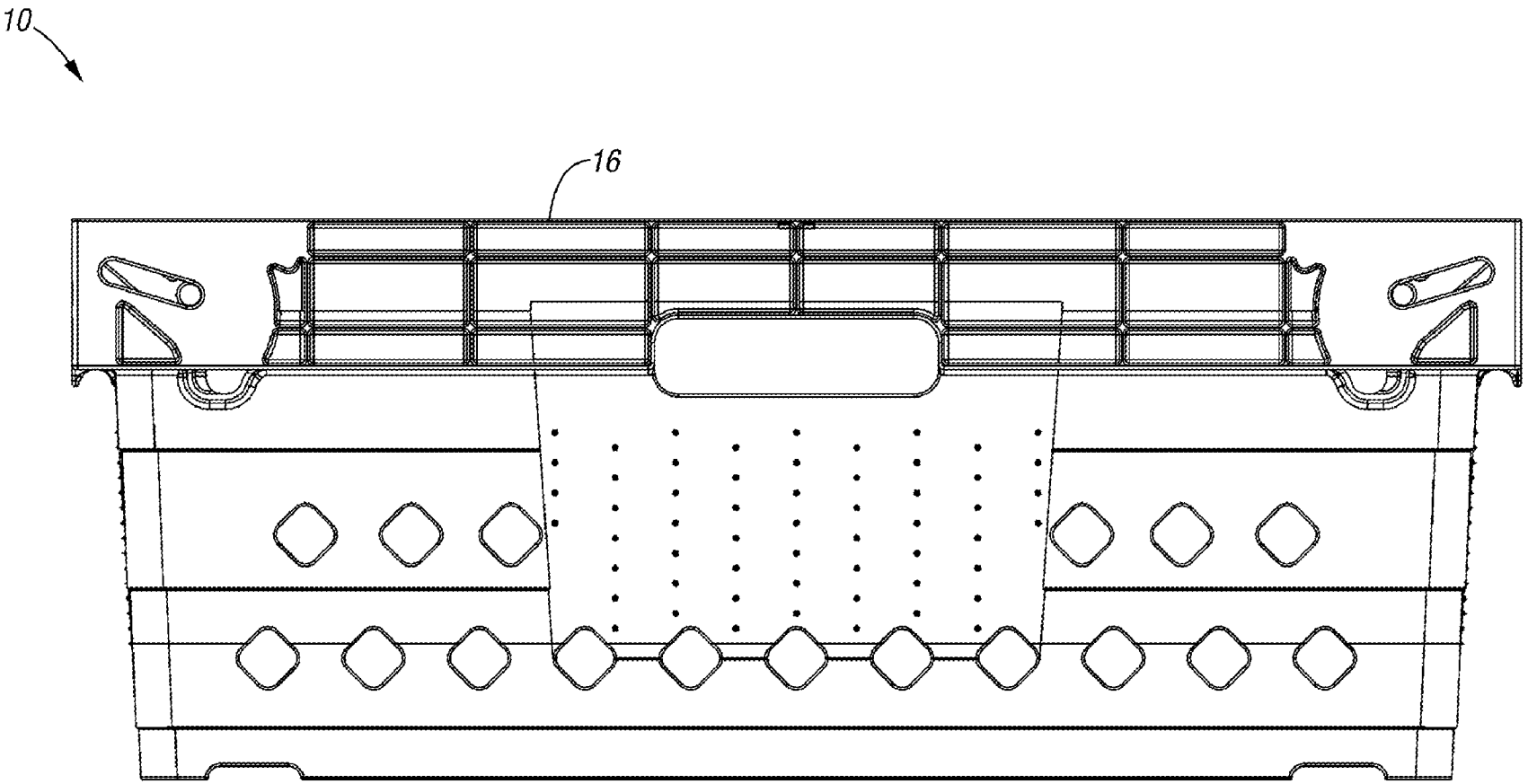
FIG. 11 is an end view of the container of FIG. 1.
Figure 12:
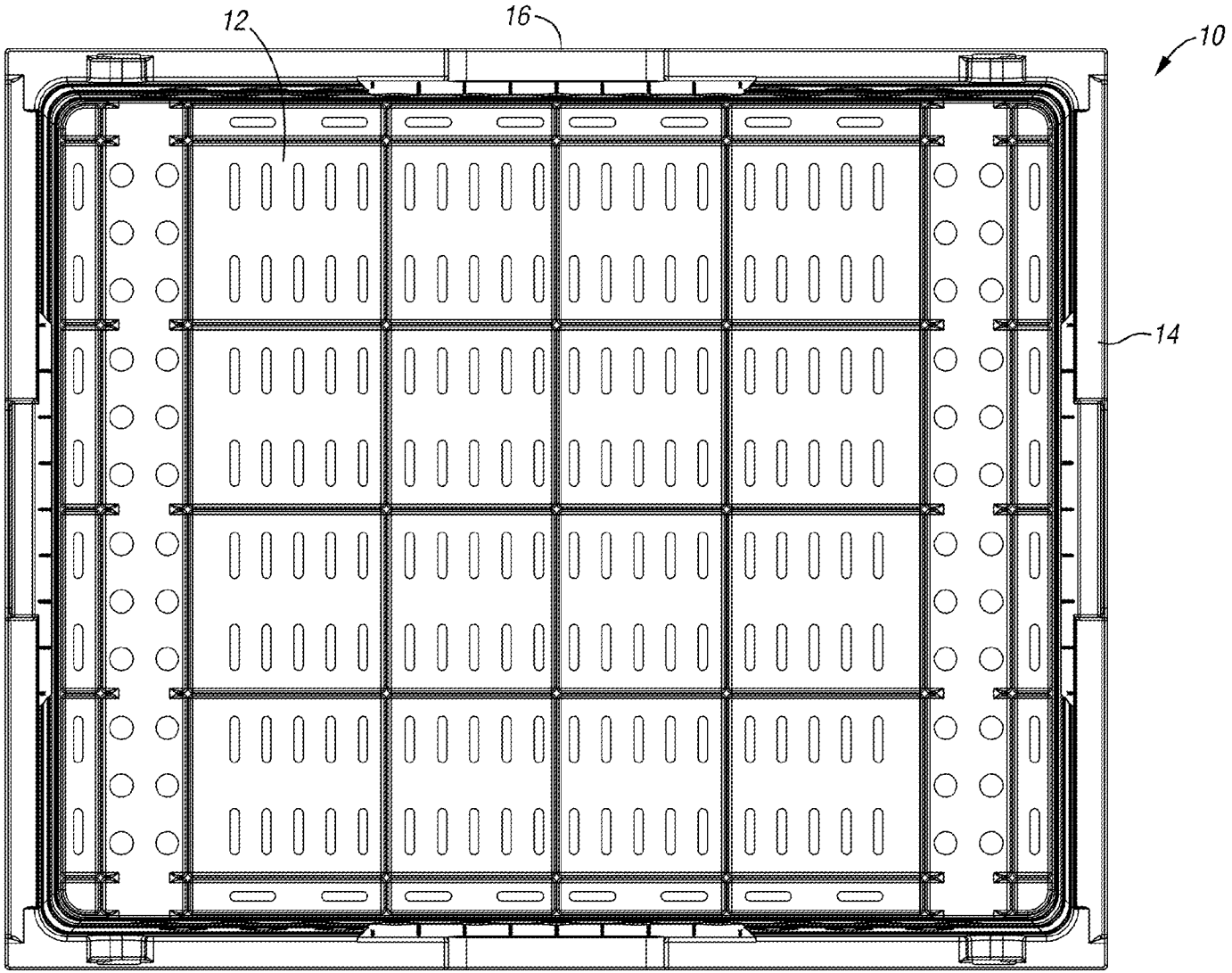
FIG. 12 is a bottom plan view of the container of FIG. 1.
Figure 13:
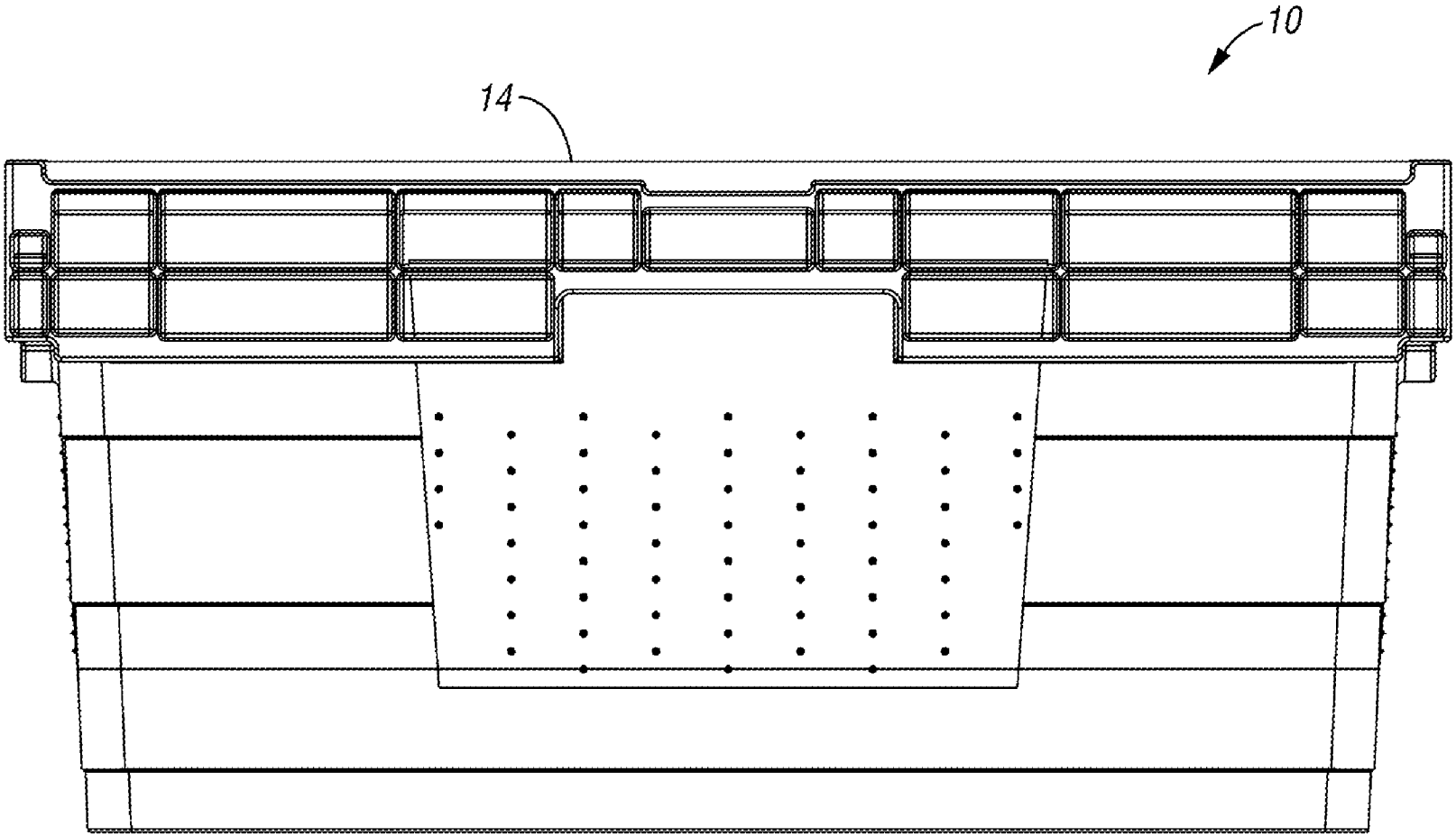
FIG. 13 is a side view of the container of FIG. 1.
Figure 14:
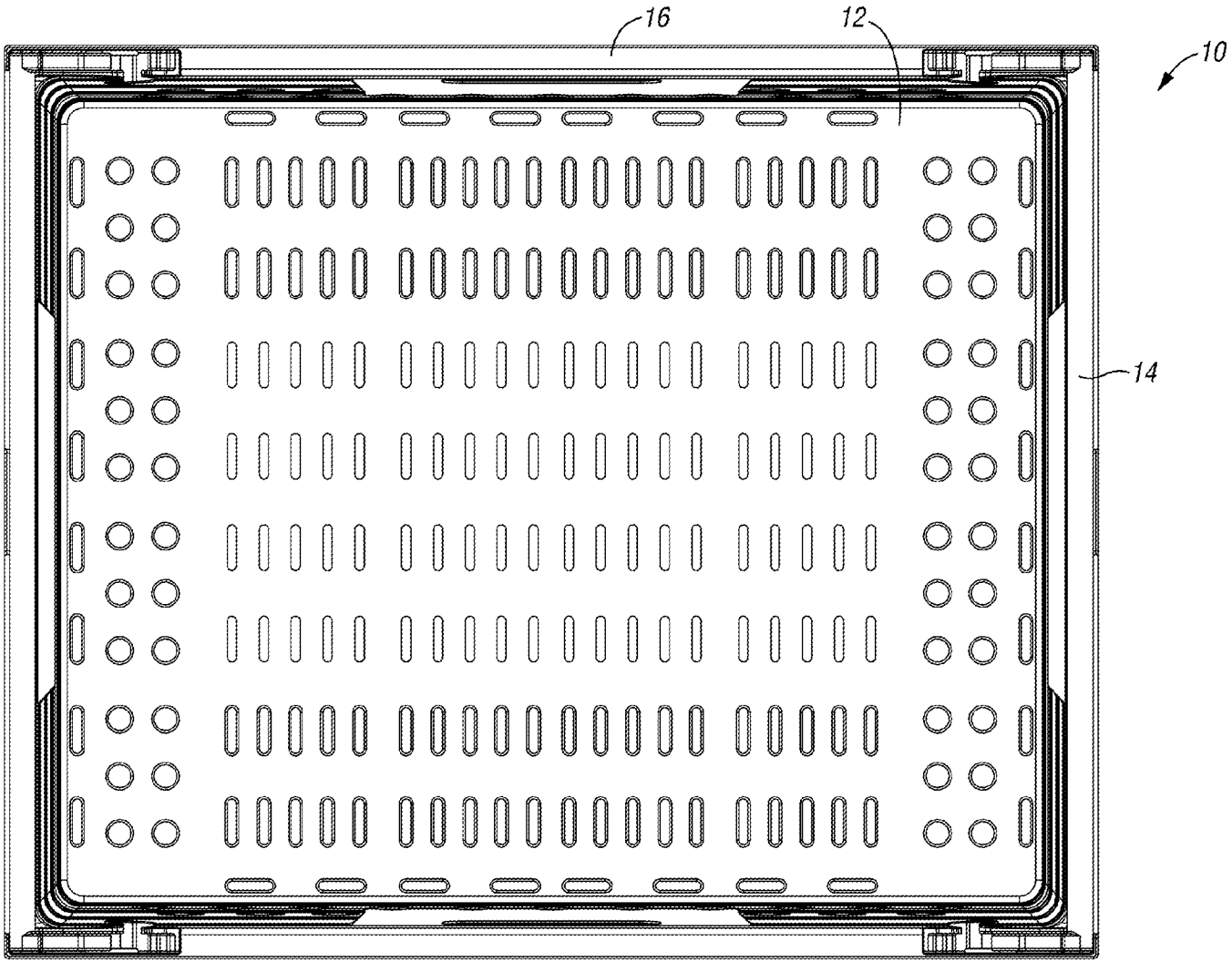
FIG. 14 is a top plan view of the container of FIG. 1.

FIG. 11 shows an end view of the container 10. FIG. 12 shows a bottom view of the container 10. FIG. 13 is a side view of the container 10. FIG. 14 is a top view of the container 10.

A container 110 according to a second embodiment of the present invention is shown in FIGS. 15-25. Components corresponding to those in the first embodiment are given a similar reference numeral, preappended with the numeral "1." The container 110 includes side walls 114 and end walls 116 extending upwardly from a floor 112. End walls 116 include outer wall portions 120 and inner wall portions 123. Pin openings 130 are formed in the outer wall portions 123 and receive the pins 132 of the bail members 118. The side walls 114 include ledges 126 protruding outwardly from the side walls 116 at a height even with the ledges 125 on the end walls 116. The ledges 126 on the side walls 114 include concave lower recesses 128 formed along their length.

Figure 15:
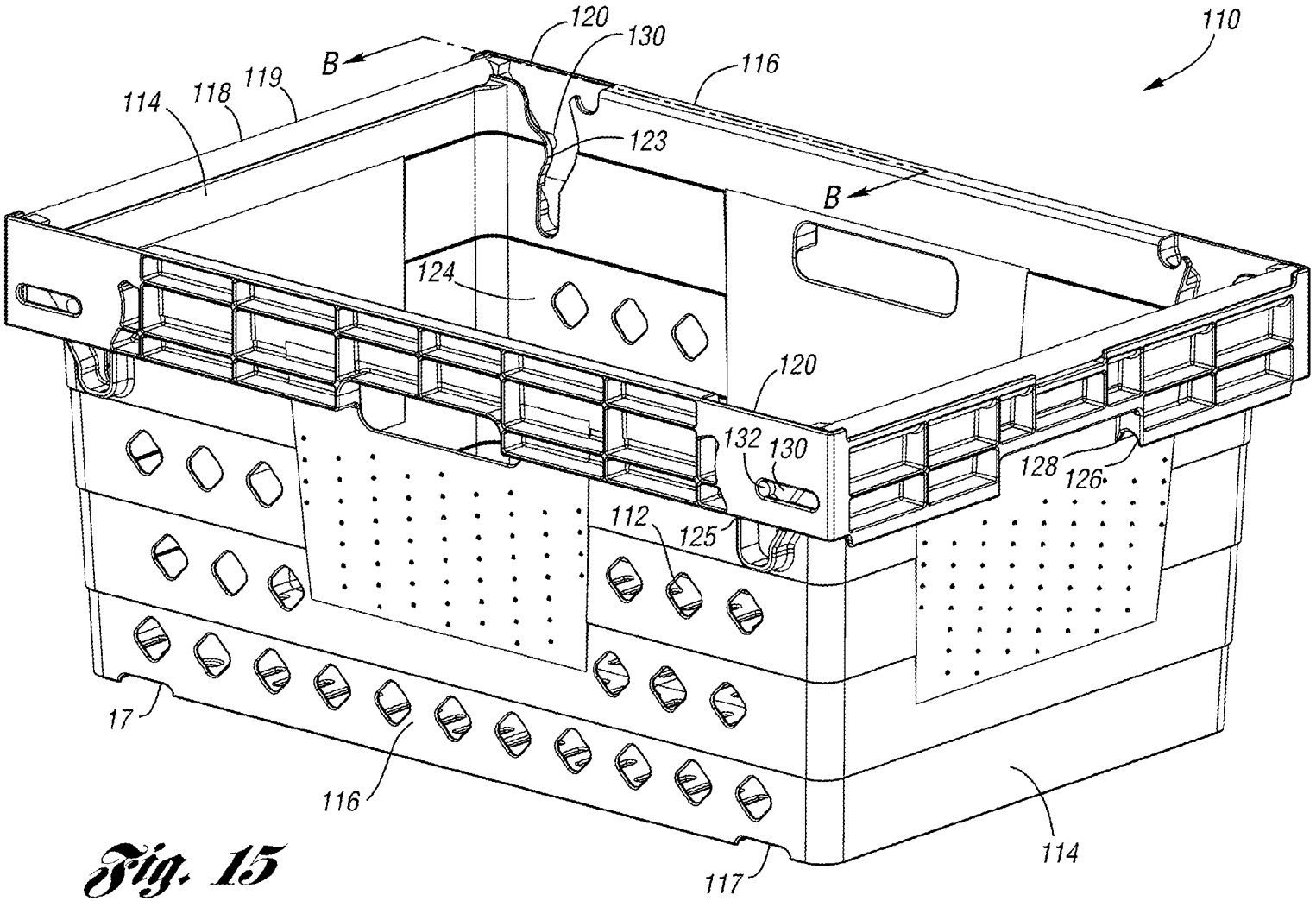
FIG. 15 is a perspective view of a container according to a second embodiment of the present invention with the bail members in a low nest position.
Figure 16:
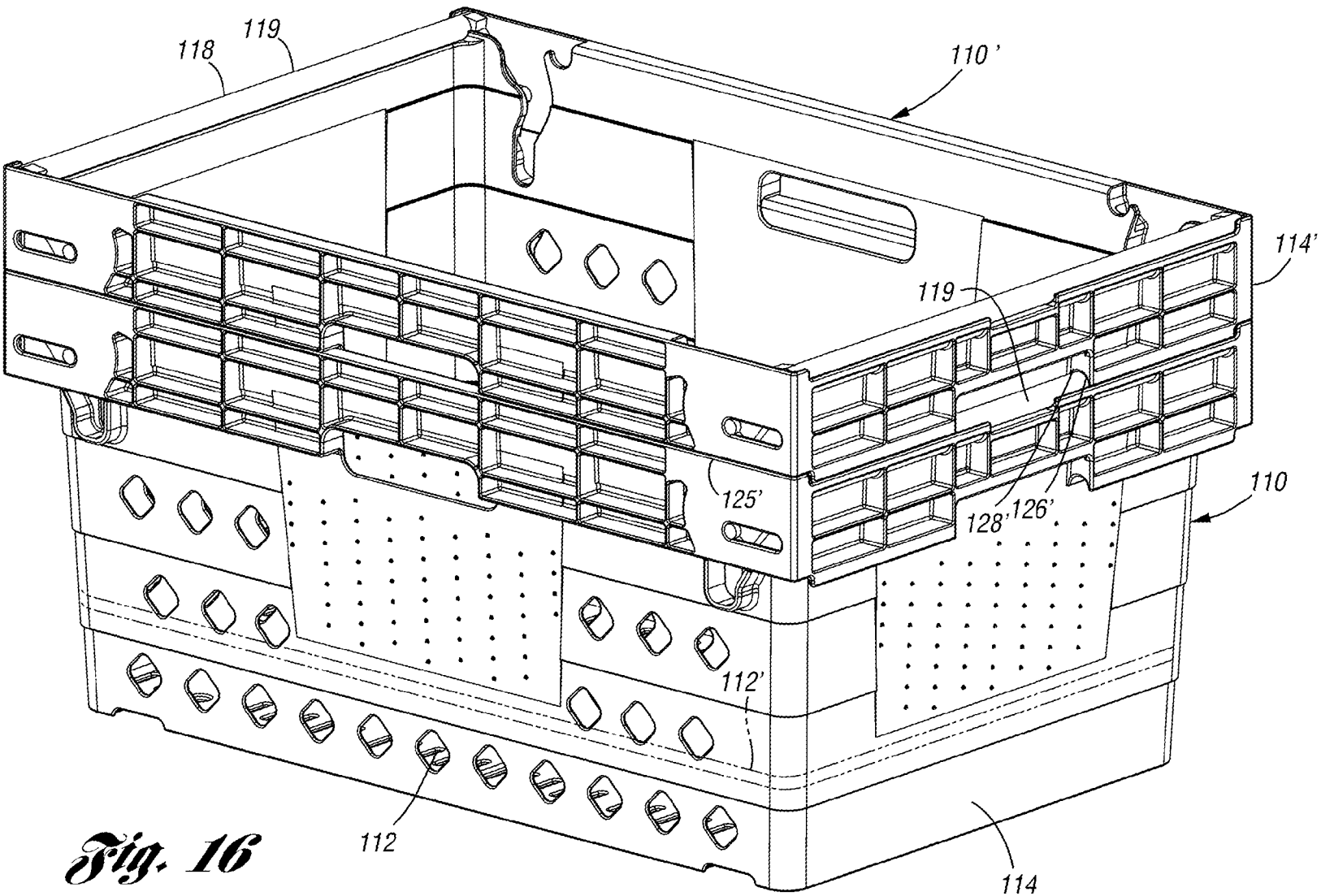
FIG. 16 is a perspective view of the container of FIG. 15 with a similar container stacked thereon.

In FIGS. 15 and 16, the bail members 118 are shown in a low nest position, with the support portions 119 of the bail members 118 on the side walls 114 and with the pins 132 at first pivot axes at inner ends of the pin openings 130. In this position, a similar container 110' can nest within the container 110 when stacked thereon, with the floor 112' of the upper container 110' at a minimal clearance above the floor 112 of the lower container 110, as shown in FIG. 16. The ledge 126' of the side wall 114' of the upper container 110' is supported on the side wall 114 of the lower container 110, with the support portion 119 of the bail member 118 of the lower container 110 received in the recess 128' of the ledge 126' of the upper container 110'.

Figure 17:
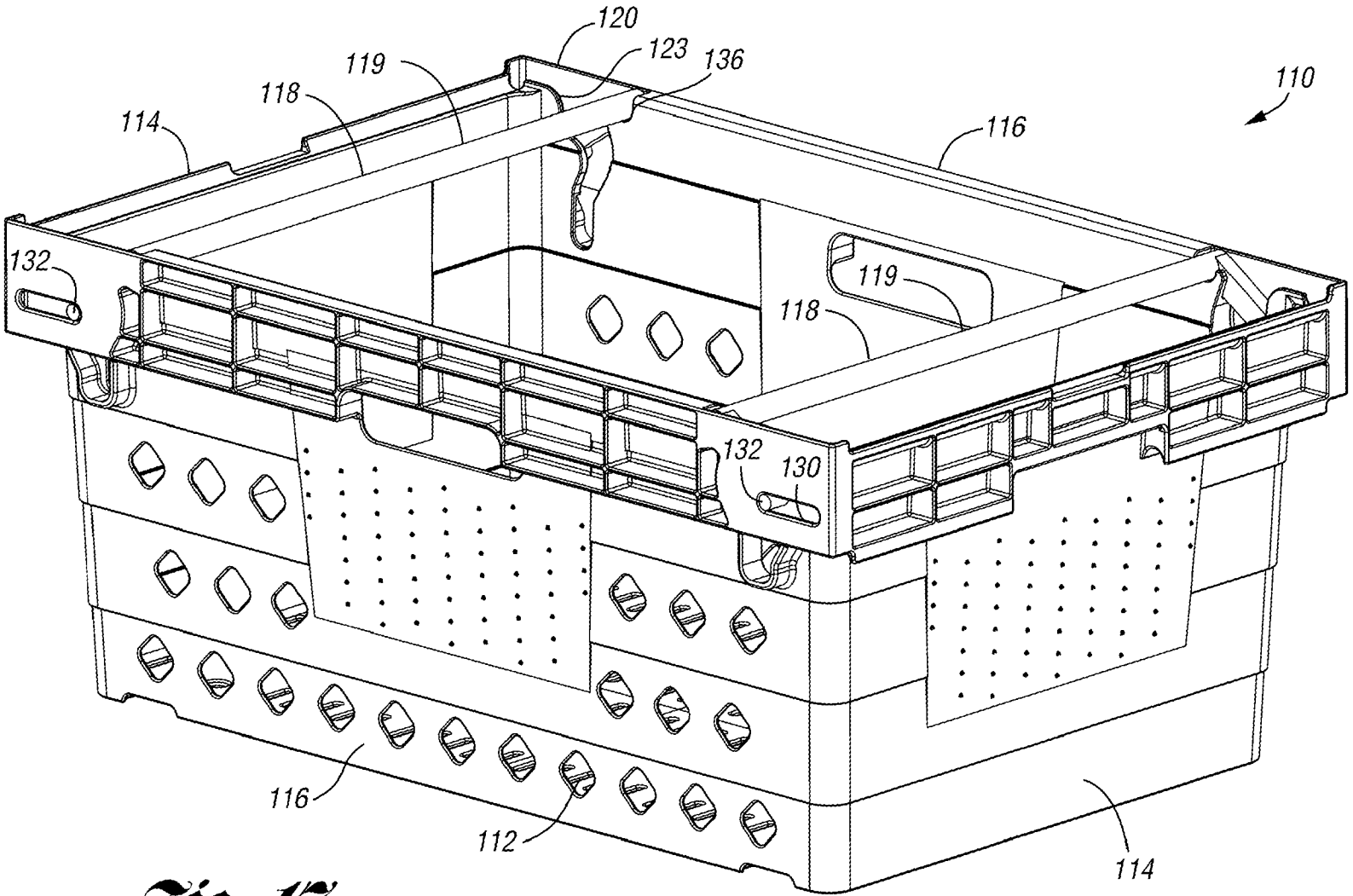
FIG. 17 is a perspective view of the container of FIG. 15 with the bail members in an upper stack position.
Figure 18:
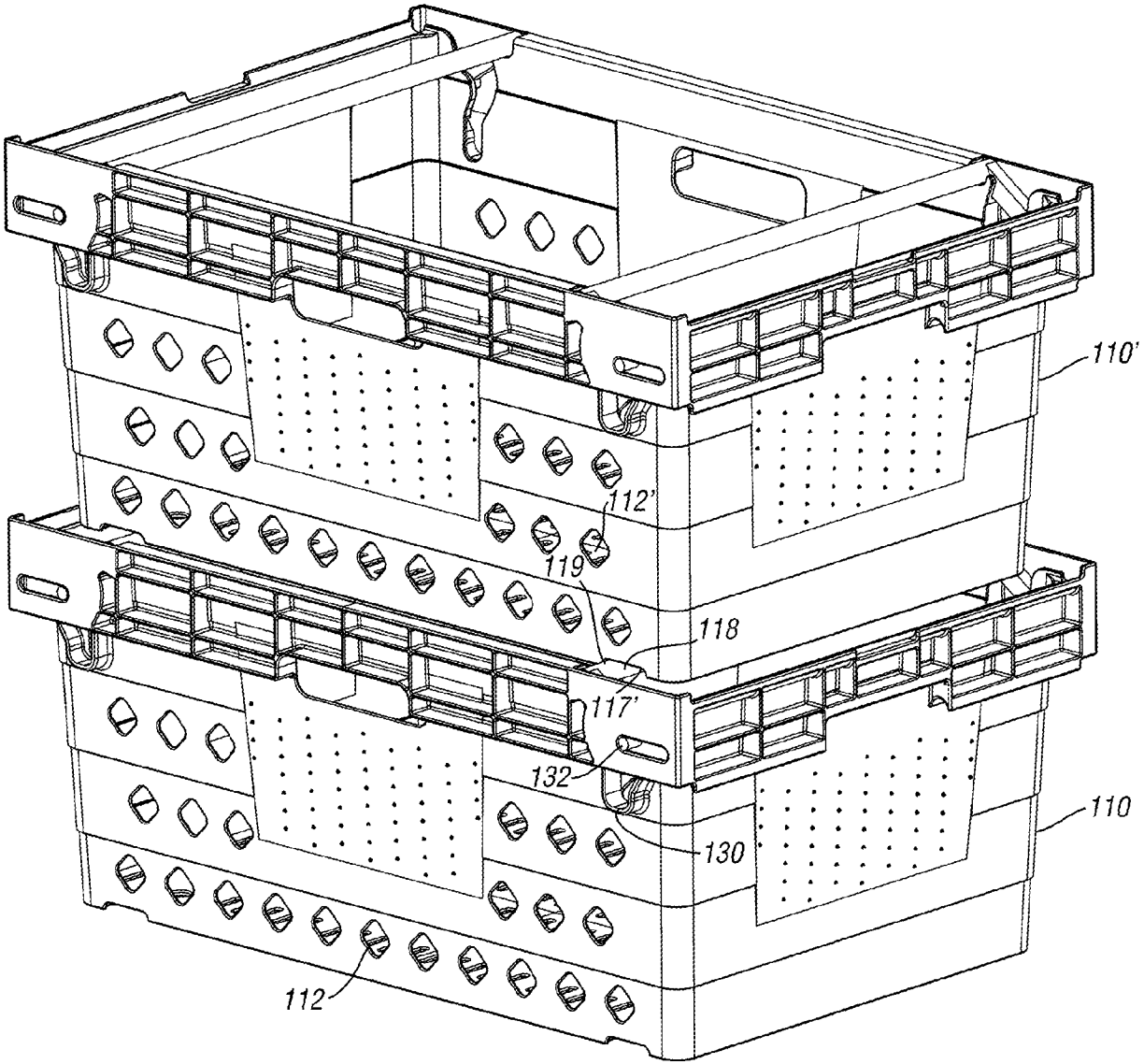
FIG. 18 illustrates the container of FIG. 17 with a similar container stacked thereon.

In FIGS. 17 and 18, the bail members 118 are shown in the upper stack position with the support portions 119 of the bail members 118 supported on support rests 136. In this position, the floor 112' of a similar container 110' is supported in notches 117' on the bail members 118 at a maximum height above the floor 112, as shown in FIG. 18. The pins 132 are still at the first pivot axes at the inner ends of the pin openings 130, as the bail members 118 are pivotable about the first pivot axes between the nest position (FIGS. 15 and 16) and the upper stack position (FIGS. 17 and 18).

Figure 19:
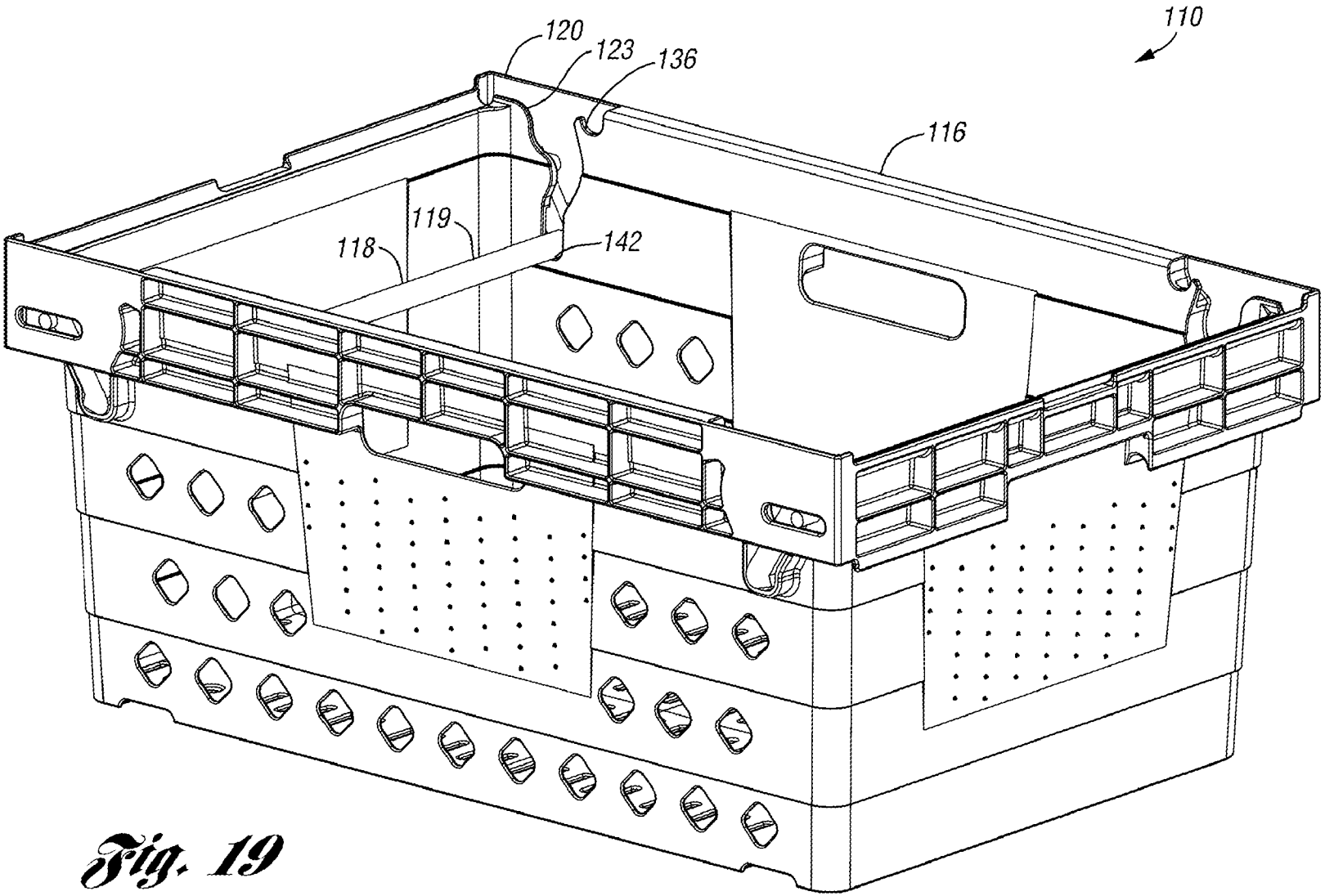
FIG. 19 is a perspective view of the container of FIG. 15 with the bail members in a lower stack position.
Figure 20:
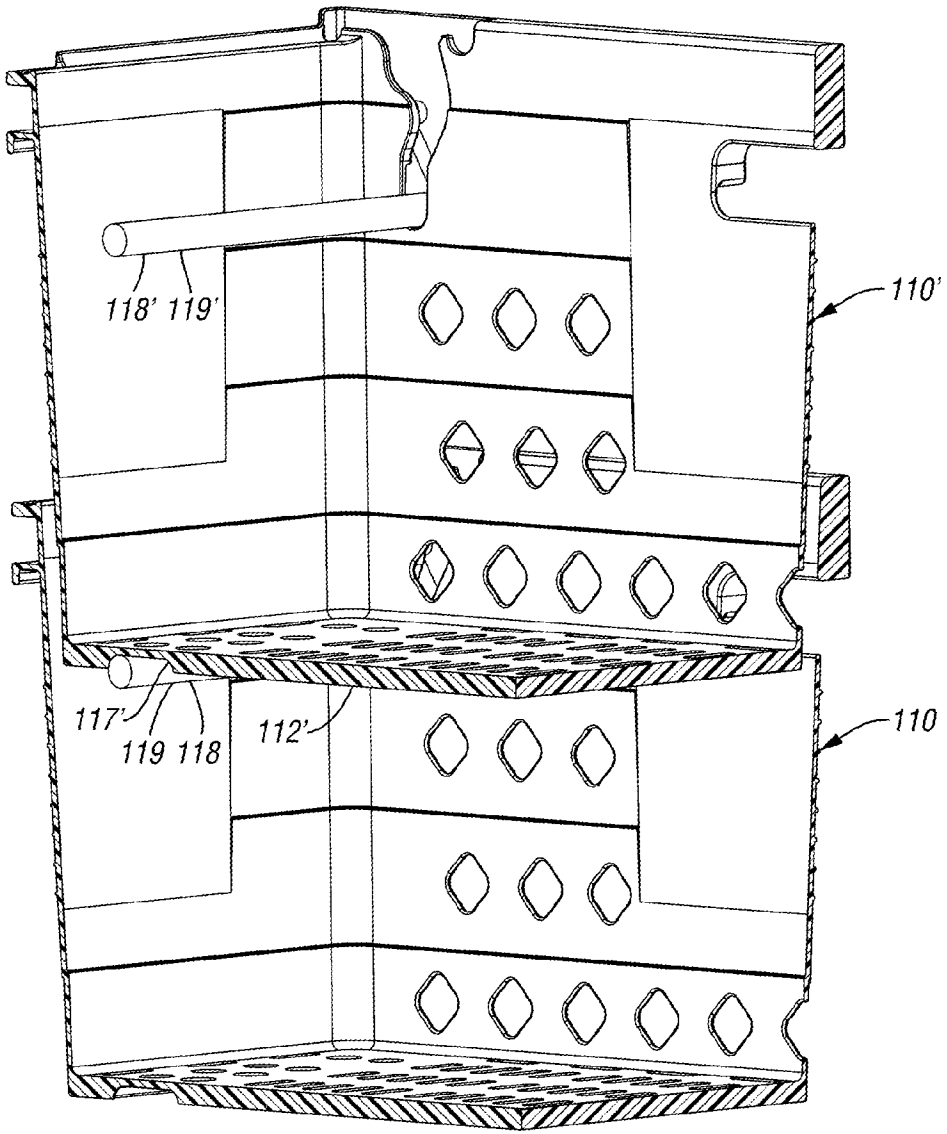
FIG. 20 is a quarter interior perspective view of the container of FIG. 19, with a similar container stacked thereon.

In FIGS. 19 and 20, the bail members 118 are shown in the lower stack position with the support portions 119 of the bail members 118 supported on the support rests 142. In this position, the floor 112' of a similar container 110' is supported on the bail members 118 above the floor 112, and the upper container 110' partially nests within the container 110 without putting contacting the contents of the container 110.

Figure 21:
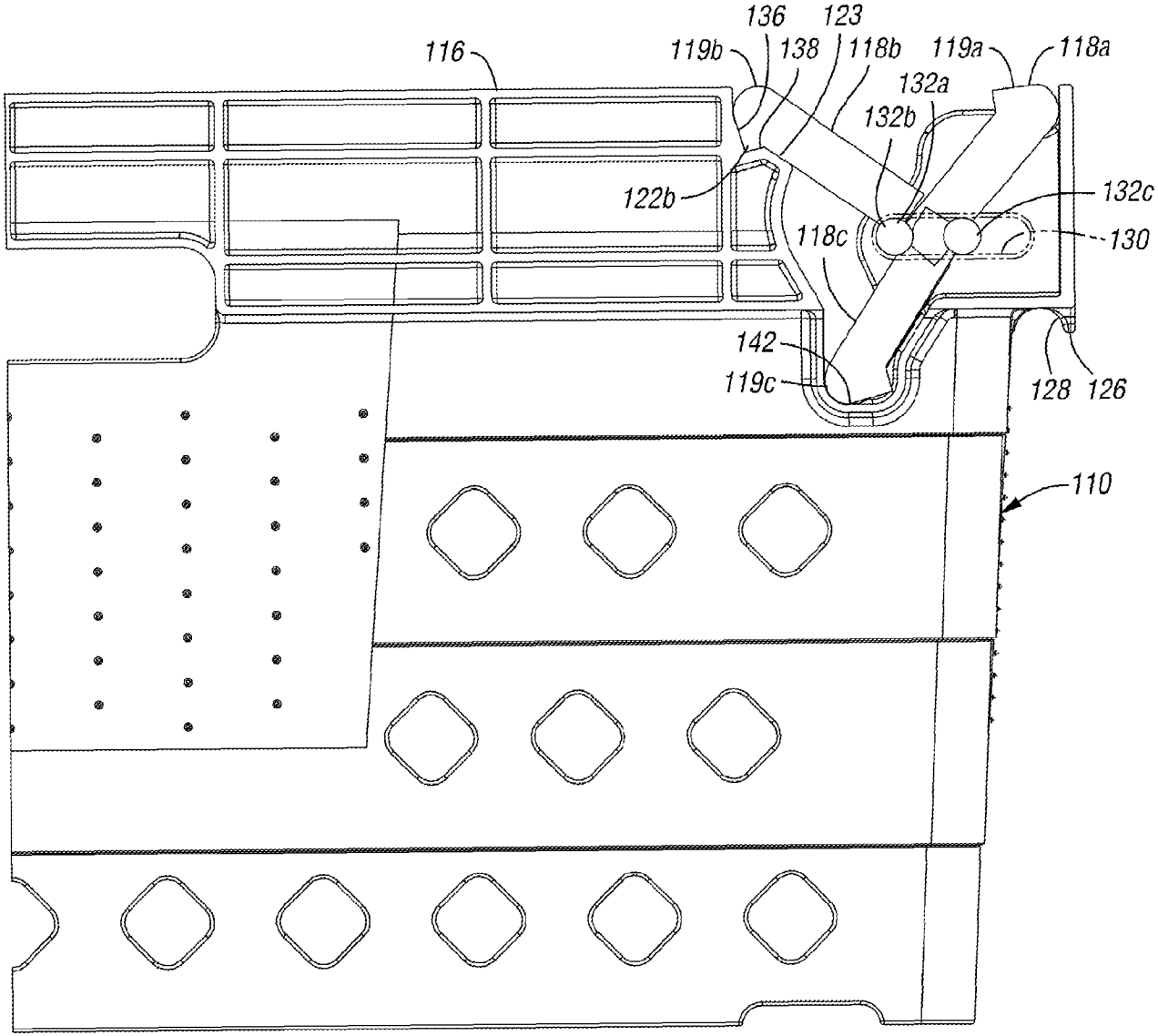
FIG. 21 is a composite sectional view taken along line B-B of FIG. 15, showing the three positions of the bail member.

FIG. 21 is an interior composite view of an end wall 116 of the container 110, showing all three of the positions of the bail members 118 and pins 132, with the reference characters "a" through "c" appended to signify the three positions. Bail member 118*a* is in the low nest position with the pin 132*a* at the first pivot axis in the pin opening 130. In the low nest position, the support portion 119*a* of the bail member 118*a* is not inwardly of the side walls 114, and thus permits nesting of a similar container in container 110.

Bail member 118*b* is in the upper stack position with the pin 132*b* at the first pivot axis in the pin opening 130. In the upper stack position, the support portion 119*b* of the bail member 118*b* is supported on support rest 136 of the inner wall portion 123, at a height substantially equal to the height of the walls 114, 116. In the upper stack position, the locking projection 122*b* is received in the locking recess 138 of the upper support rest 136. The locking projection 122*b* and locking recess 138 interlock to retain the support portion 119*b* of the bail member 118*b* in the upper support rest 136.

Bail member 118*c* is in the lower stack position with the pin 132*c* in the second pivot axis in the pin opening 130, between inner and outer ends of the pin opening 130. In the lower stack position, the support portion 119*c* of the bail member 118*c* is supported on support rest 142 of the inner wall portion 123.

Figure 22:
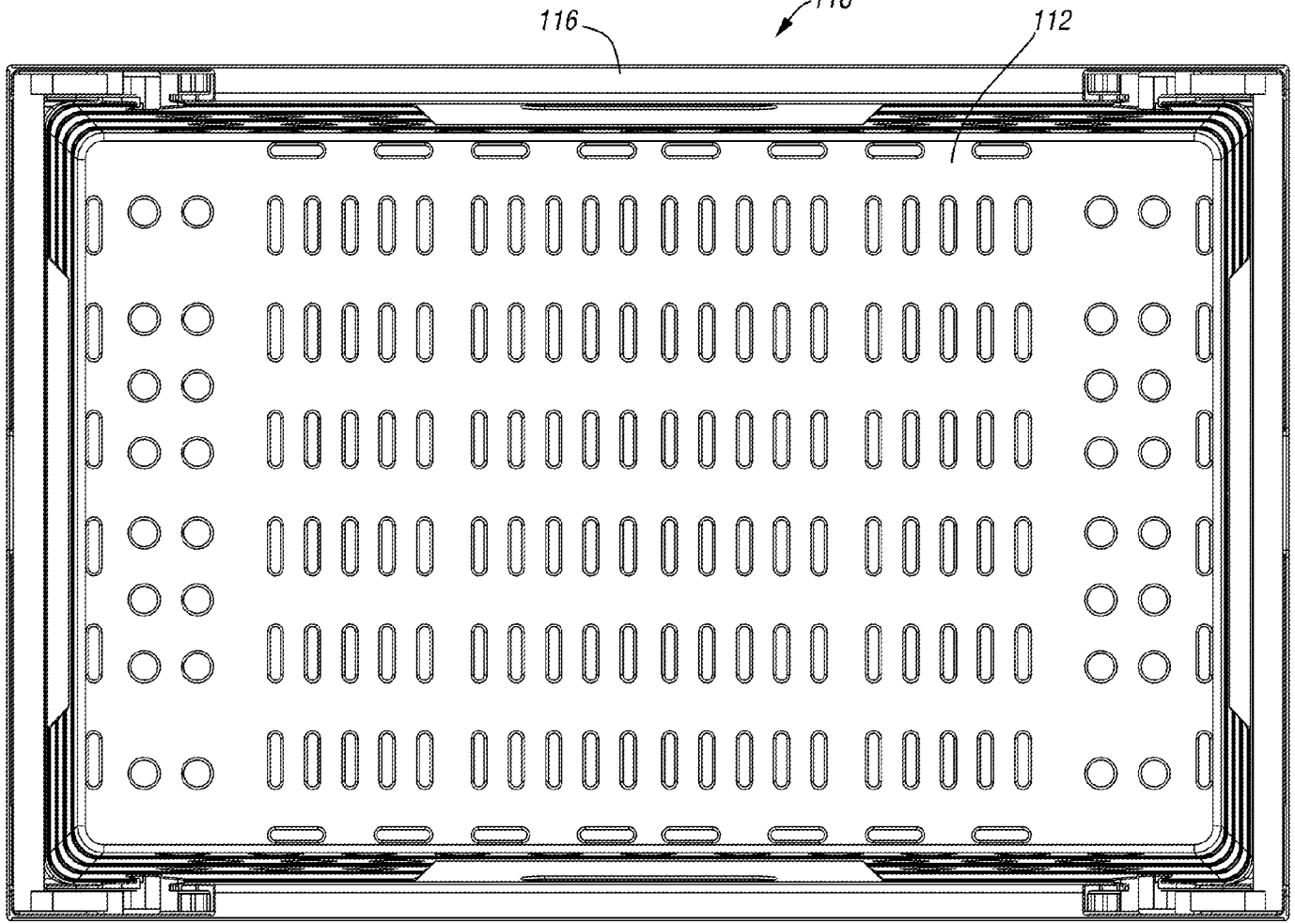
FIG. 22 is a top view of the container of FIG. 15.
Figure 23:
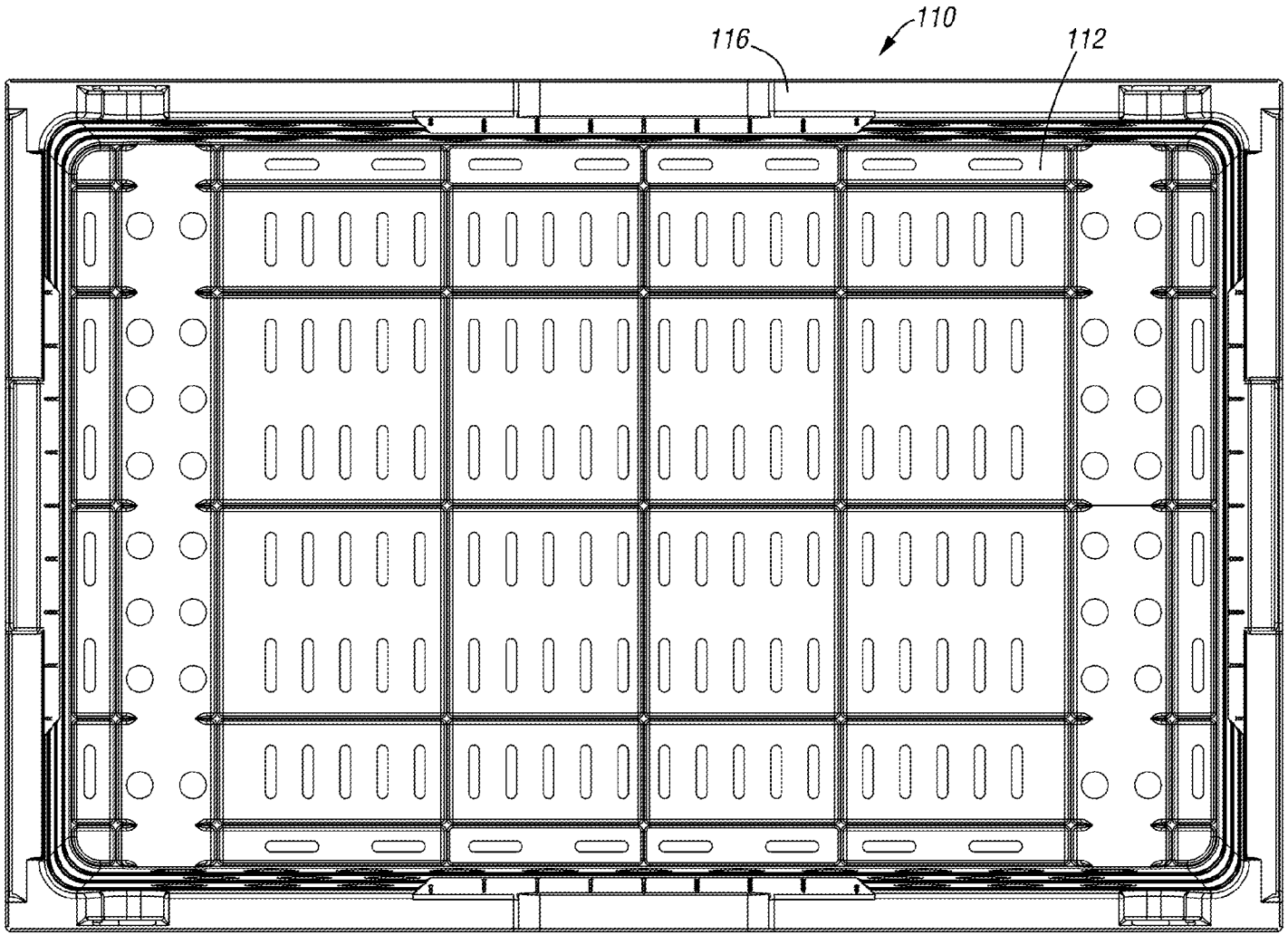
FIG. 23 is a bottom view of the container of FIG. 15.
Figure 24:
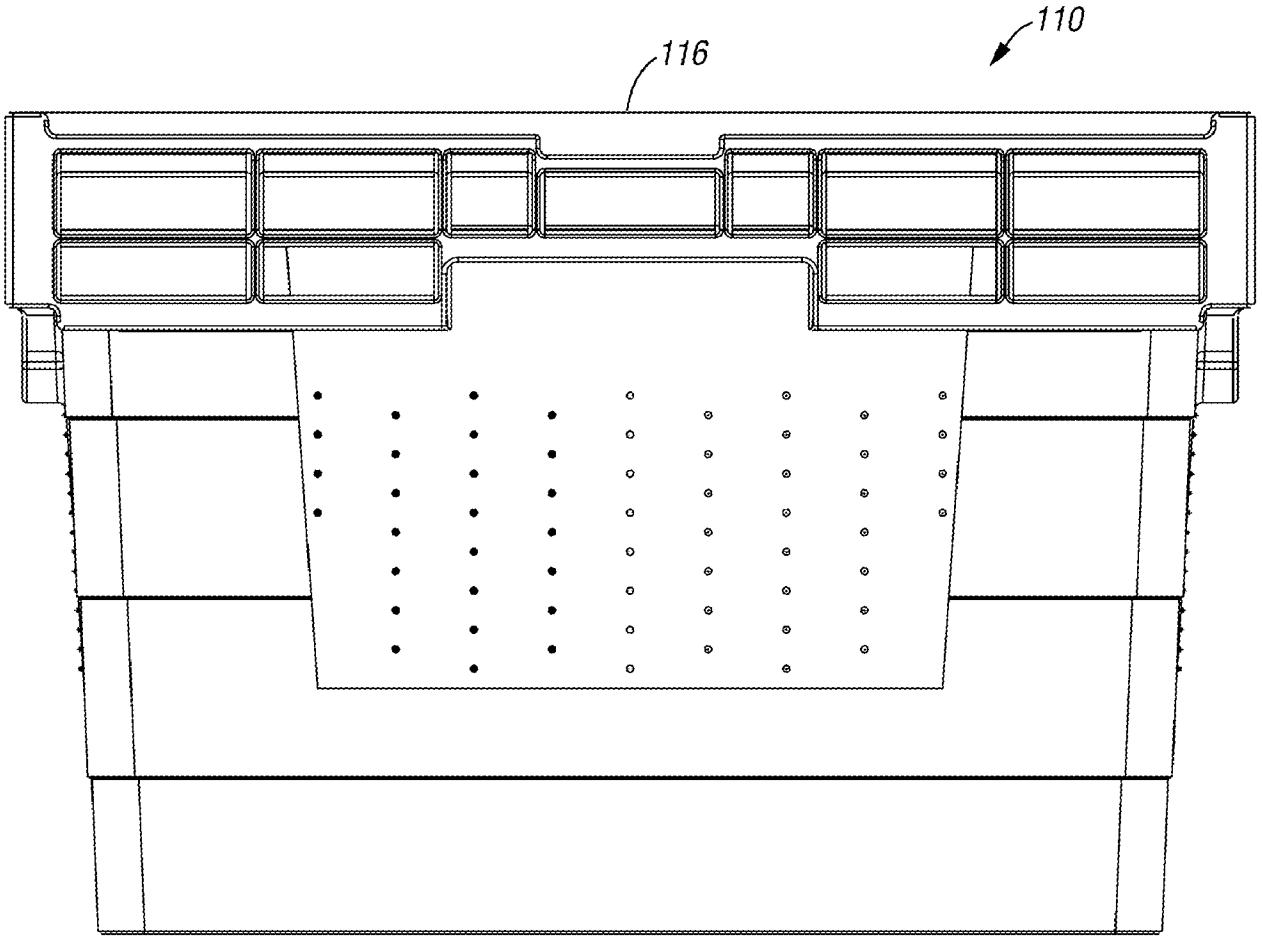
FIG. 24 is a side view of the container of FIG. 15.
Figure 25:
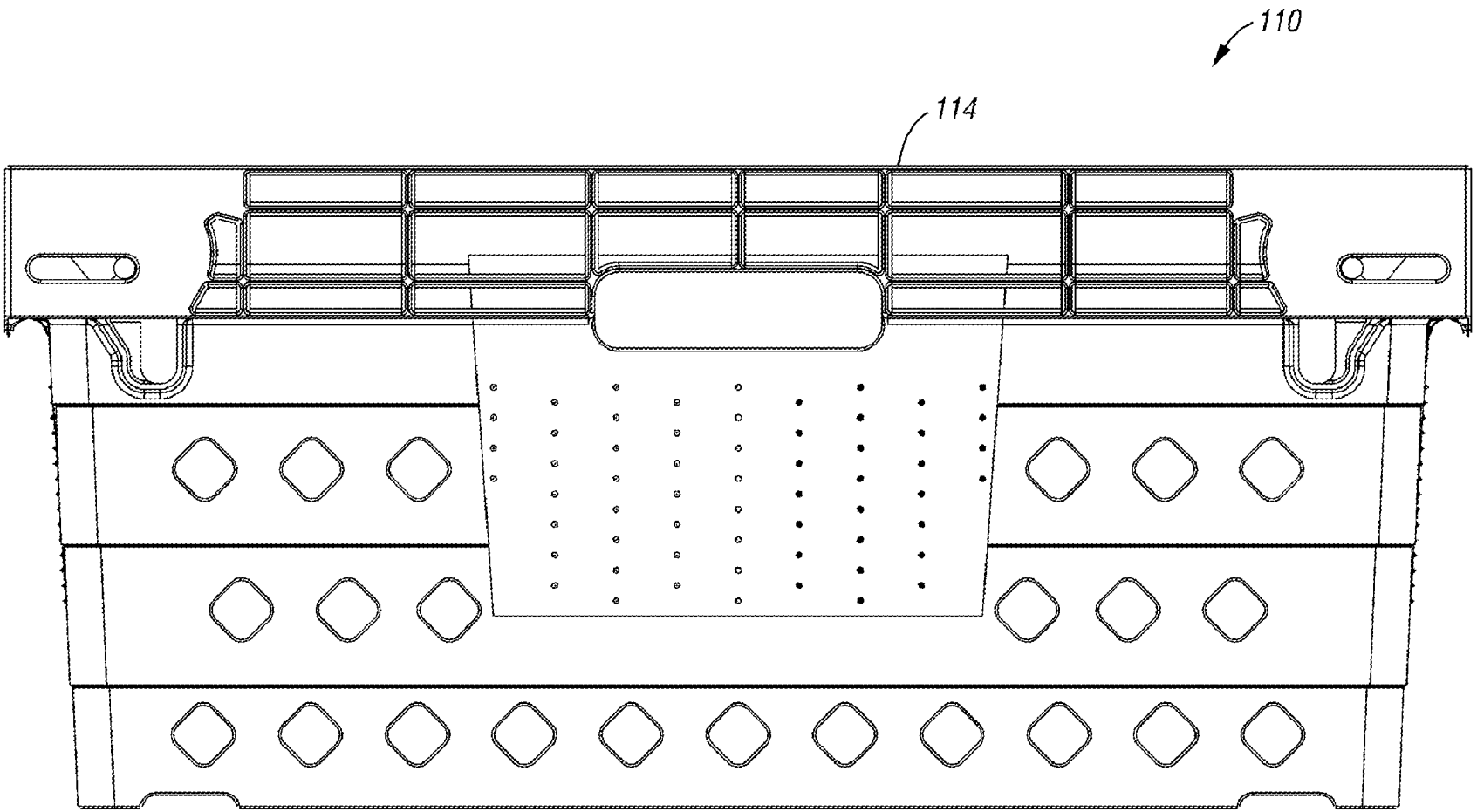
FIG. 25 is an end view of the container of FIG. 15.

FIG. 22 shows a top view of the container 110. FIG. 23 shows a bottom view of the container 110. FIG. 24 is a side view of the container 110. FIG. 25 is an end view of the container 110.

The container 110 of FIGS. 15-25 provides three selectable heights between floors 112 of stacked containers, including the low nest position (FIGS. 15 and 16), upper stack position (FIGS. 17 and 18) and lower stack position (FIGS. 19 and 20) Depending on how much is to be stored in the container 110, the bail members 118 can be adjusted to support similar containers 110' stacked thereon in the three positions without resting on the contents and without unnecessarily occupying space.

In both embodiments, the walls and floor of the container 10, 110 are integrally molded as a single unitary structure from a plastic material such as HDPE, or other suitable materials, for example polypropylene, via an injection molding or other suitable process. The bail members 18, 118 may be formed of any suitable material, but are preferably 50% glass-filled nylon or other composite material, but could also be steel. The container 10 of FIGS. 1-14 and the container 110 of FIGS. 15-25 are also designed to be stacked together as shown in FIGS. 26-29. In the embodiments shown, the container 10 is 24 inches by 20 inches, while the container 110 is 24 inches by 16 inches. Of course, other sizes would be within the scope of the present invention, but these sizes are used for purposes of illustration below.

Figure 26:
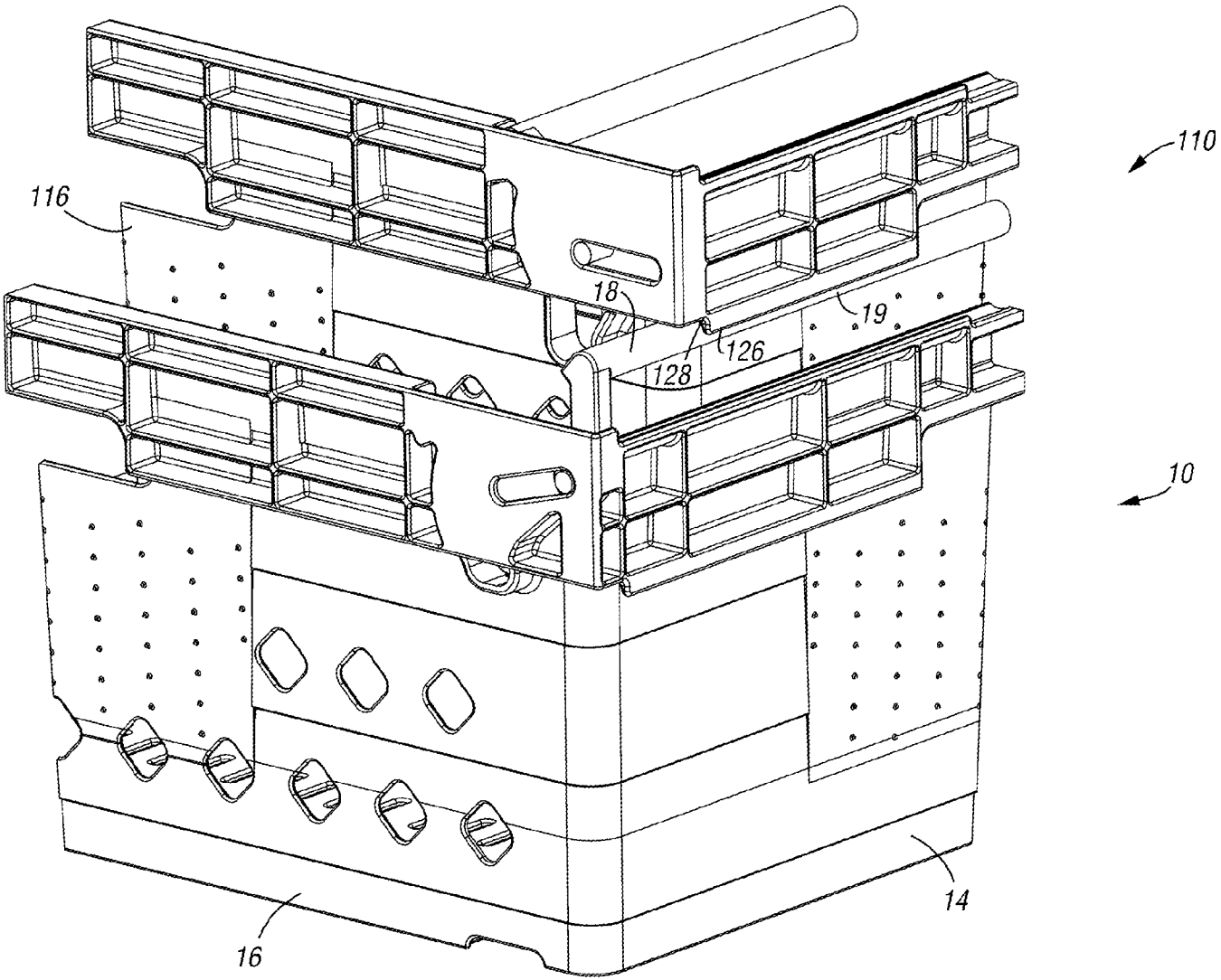
FIG. 26 is a partial exterior perspective view of the container of FIG. 15 stacked on the container of FIG. 1 in the high nest position.
Figure 27:
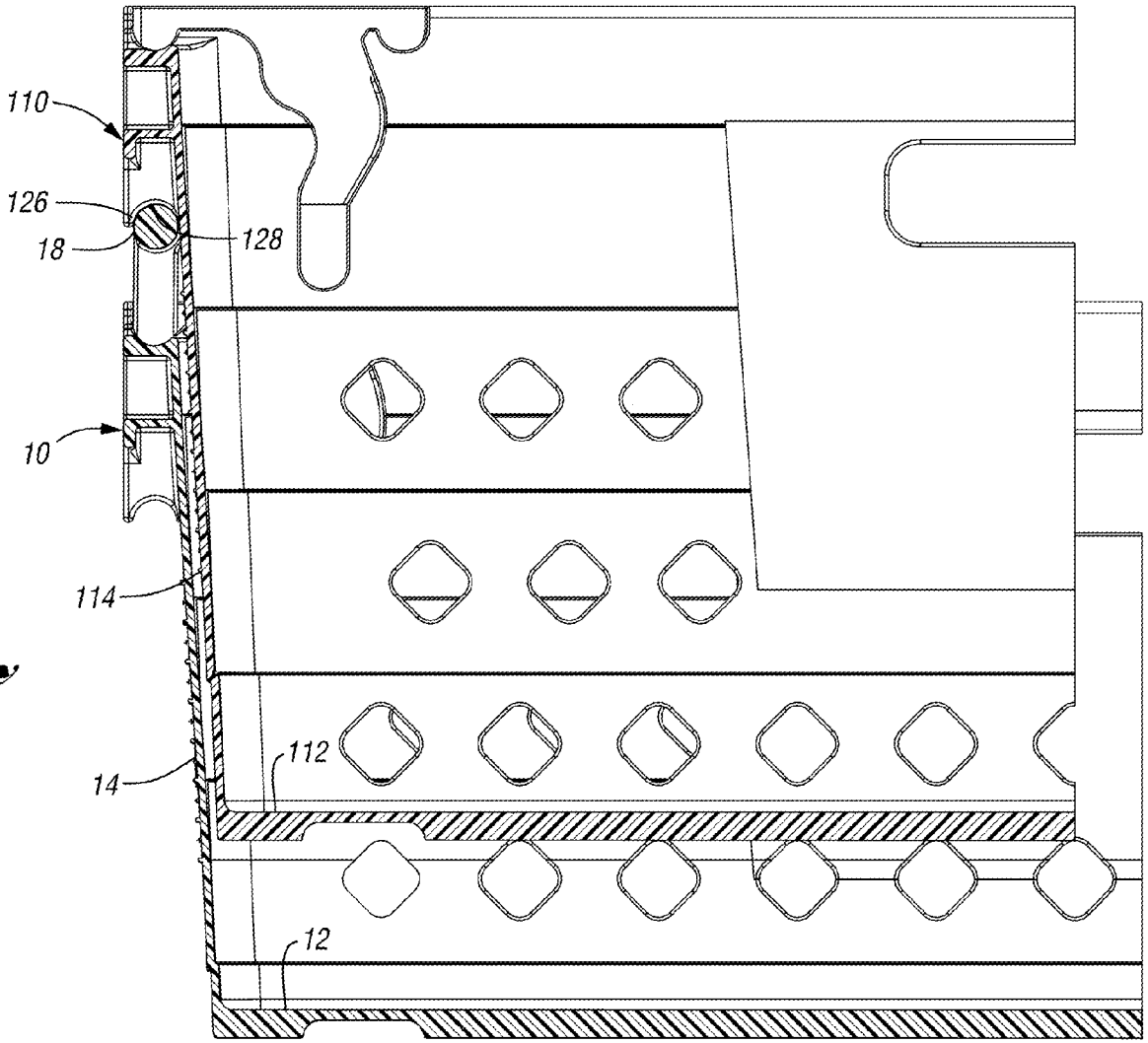
FIG. 27 is a sectional view of the containers of FIG. 26.

In FIGS. 26 and 27, the bail member 18 of the lower container 10 is in the high nest position, such that the support portion 19 of the bail member 18 is spaced above the uppermost edges of the side walls 14 and end walls 16. The support portion 19 is received within the recess 128 on the ledge 126 of the upper container 110 to support the container 110 partially nested within the container 10, thereby protecting the contents of the lower container 10 between floors 12, 112 while efficiently stacking the containers 10, 110. It should be noted that, in embodiments having the dimensions stated above, there will be a 2-inch gap between the side walls 116 of the upper container 110 and the side walls 16 of the lower container 10, but stability is not affected.

Figure 28:
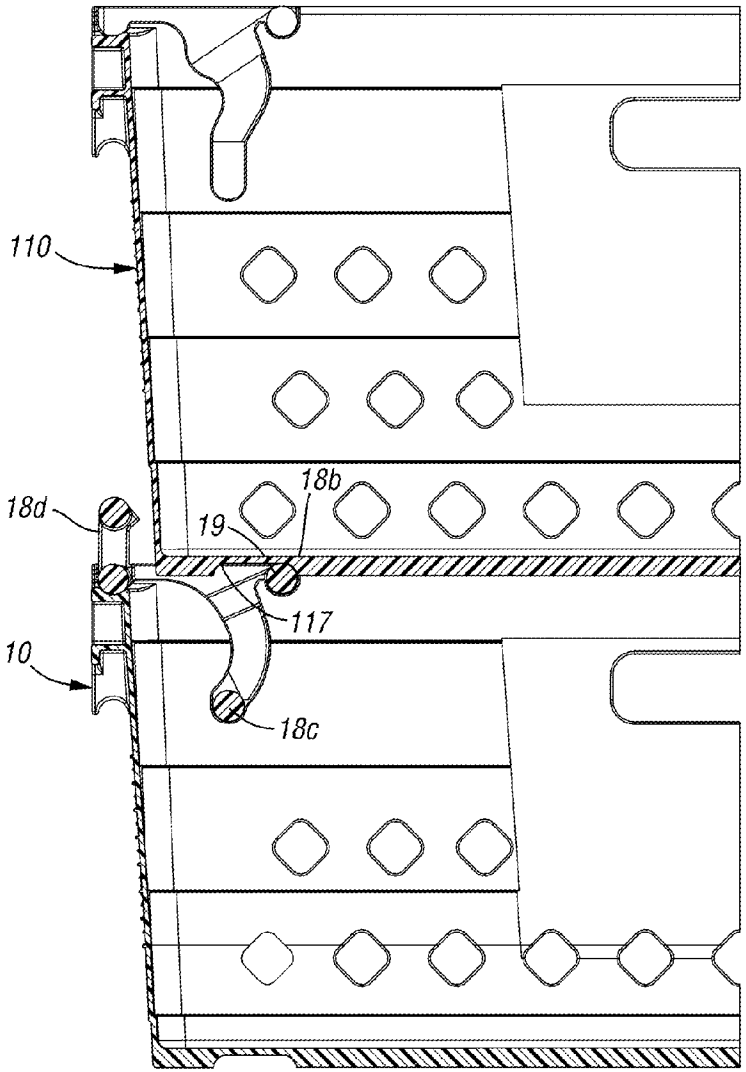
FIG. 28 is a view similar to FIG. 27, with the lower container in the upper stack position.
Figure 29:
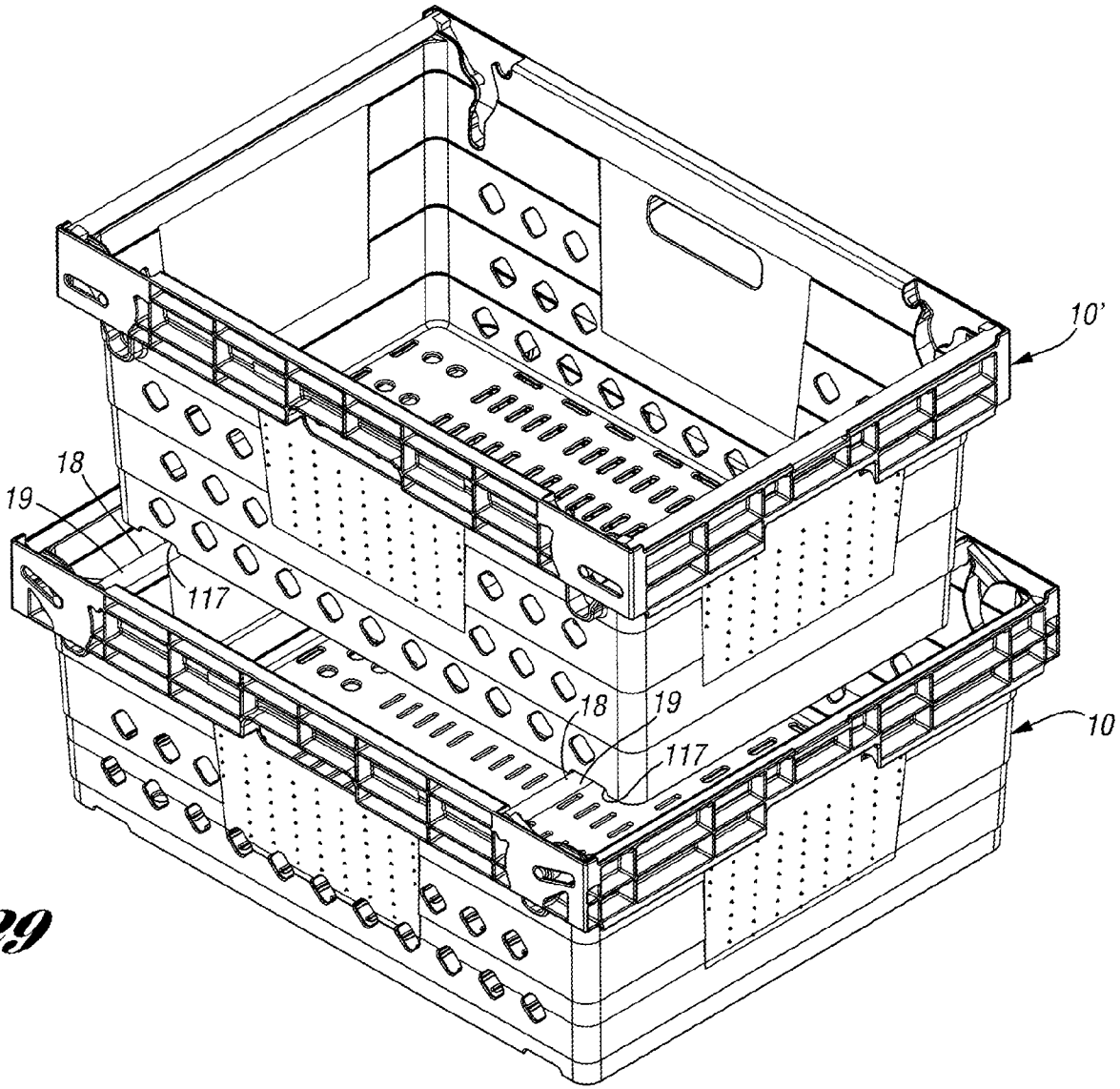
FIG. 29 illustrates the container of FIG. 1 with the bail members in the upper stack position and with the container of FIG. 15 stacked thereon.

FIGS. 28 and 29 illustrate the container 110 stacked on the container 10 while the bail members 18 are in the upper stack position. FIG. 28 shows a composite view of the lower container 10, showing the bail member 18 in three of the four positions, again designated 18*b-d*. As shown, the notch 117 of the upper container 110 aligns with the bail member 18*b* in the upper stack position and the bail member 18*c* in the lower stack position.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are different designs of containers that would benefit from the present invention.

What is claimed is:

1. A container capable of supporting a second container in a plurality of positions relative to the container, the container comprising:

a floor;

an upstanding wall structure including a plurality of walls extending upwardly from the floor; and a bail member having a support portion and an arm extending transversely from the support portion, the bail member selectively movable between a low nest position and a high nest position, wherein the bail member is operable to support the second container at a first nested distance above the floor when the bail member is in the low nest position and a second nested distance above the floor when the bail member is in the high nest position, wherein the support portion is located within a first vertical plane outward of an outer periphery of the floor when the bail member is in the low nest position and when the bail member is in the high nest position, and wherein a distance from the support portion to the floor is greater when the bail member is in the high nest position than when the bail member is in the low nest position.

2. The container of claim 1 wherein the first vertical plane is positioned outwardly of an outer surface of a first wall of the plurality of walls, the outer surface of the first wall parallel to the support portion.

3. The container of claim 2 wherein the first wall includes a support projecting outwardly from the outer surface, the support being within the first vertical plane, at least substantially vertically aligned with the support portion in the high nest position.

4. The container of claim 3 wherein the support is a ledge protruding outwardly from the outer surface.

5. The container of claim 2 wherein the support portion includes a concave lower surface.

6. The container of claim 1 wherein one of the walls includes an outer wall portion and an inner wall portion spaced inwardly from the outer wall portion, at least one of the inner and outer wall portions having an elongated pin opening, the bail member further including a pin extending transversely from the arm, and wherein the pin received in the pin opening such that the bail member is pivotable and slidable in the pin opening.

7. The container of claim 6 wherein the one of the walls includes a lower wall portion and wherein the inner and outer wall portions are an upper wall portion, wherein the inner wall portion is aligned with the lower wall portion and wherein the outer wall portion is positioned outwardly of the lower wall portion to at least partially define a ledge projecting outwardly from an outer surface of the one of the walls, the ledge being within the first vertical plane, at least substantially vertically aligned with the support portion in the high nest position.

8. The container of claim 1 wherein the bail member is further movable between a first stack position in which the support portion is a first distance from the floor and a second stack position in which the support portion is a second distance from the floor, the second distance being different from the first distance, wherein the support portion of the bail member is located in a second vertical plane inward of the outer periphery of the floor when the bail member is in the first stack position and wherein the bail member is located in a third vertical plane inward of the outer periphery of the floor when the bail member is in the second stack position.

9. The container of claim 8 wherein the bail member is pivotable about a first pivot axis between the low nest position and the first stack position.

10. The container of claim 8 further including a plurality of support rests on which the support portion is supported in each of the first stack position and the second stack position.

11. The container of claim 1 wherein the arm is one of two arms extending transversely from opposite ends of the support portion.

12. A container capable of supporting a second container in a plurality of positions relative to the container, the container comprising:

a floor;

an upstanding wall structure including a plurality of walls extending upwardly from the floor, one of the plurality of walls having an elongated pin opening; and a bail member having a support portion and an arm extending transversely from the support portion, the bail member further including a pin extending transversely from the arm, the pin received in the pin opening such that the bail member is pivotable and slidable in the pin opening, the bail member selectively movable between a nest position, an upper stack position and a lower stack position, wherein the pin is at a first axis in the pin opening when the bail member is in the nest position and the pin is at the first axis when the bail member is in the upper stack position, a first distance from the first axis to the floor is less than a second distance from the support portion to the floor in the upper stack position, the support portion is a third distance from the floor and the pin is at a second axis outward of the first axis when the bail member is in the lower stack position, wherein the third distance is less than the second distance.

13. The container of claim 12 wherein the third distance is less than the first distance.

14. The container of claim 12 wherein the one of the walls includes an outer wall portion and an inner wall portion spaced inwardly from the outer wall portion, at least one of the inner and outer wall portions having the elongated pin opening.

15. The container of claim 14 wherein the one of the wails includes a lower wall portion and wherein the inner and outer wall portions are an upper wall portion, wherein the inner wall portion is aligned with the lower wall portion and wherein the outer wall portion is positioned outwardly of the lower wall portion.

16. A container capable of supporting a second container in a plurality of positions relative to the container, the container comprising:

a floor;

an upstanding wall structure including a plurality of walls extending upwardly from the floor, the plurality of walls including a first wall having a locking recess; and a bail member having a support portion extending across at least a portion of the container, the bail member including an arm extending from the support portion, the arm pivotably and slidably mounted to the container, the arm having a locking projection protruding therefrom, the bail member pivotable and slidable between a first position and a second position, the bail member supported on the first wall with the locking projection received in the locking recess when the bail member is in the first position.

17. The container of claim 16 wherein the support portion of the bail member has a generally cylindrical outer surface and wherein the locking projection protrudes radially outwardly from the cylindrical outer surface.

18. The container of claim 17 wherein the arm and the support portion generally define a plane, the locking projection protruding outwardly from the plane.

19. The container of claim 16 wherein the first wall includes a concave recess adjacent the locking recess, the concave recess supporting the support portion of the bail member when the bail member is in the first position.

20. A method for stacking an upper container onto a lower container including the steps of:

a) moving a bail member of the lower container from a low nest position in which a support portion of the bail member is a first distance from a floor of the lower container to a high nest position in which the support portion is a second distance from the floor of the lower container, the second distance greater than the first distance, the support portion above an uppermost edge of walls of the lower container when the bail member is in the high nest position; and b) nesting the upper container in the lower container such that a floor of the upper container is below the support portion of the bail member and the upper container is supported on the support portion of the bail member, wherein at least one wall of the lower container provides vertical support to the bail member when the bail member is in the high nest position such that the bait member can support the upper container thereon.

21. The method of claim 20 wherein, in said step b), a ledge projecting outwardly from a wall of the upper container is supported on the support portion.

22. The container of claim 5 wherein the convex lower surface of the support portion engages a concave recess.

23. The container of claim 9 wherein the bail member is pivotable about a second pivot axis when the bail member is in the second stack position.

24. The container of claim 1 wherein the first nested distance is less than the second nested distance.

25. The method of claim 20 wherein a position of the support portion in the low nest position and a position of the support portion in the high nest position are vertically aligned within a vertical plane.

26. The container of claim 23 wherein the first pivot axis is a third distance from the floor, the third distance less than the first distance and greater than the second distance and wherein the first pivot axis is positioned inwardly of the second pivot axis.

* * * * *